US012618301B2

(12) United States Patent
Yoneda et al.

(10) Patent No.: US 12,618,301 B2
(45) Date of Patent: May 5, 2026

(54) JOINT ASSEMBLY, PRODUCTION WELL MANUFACTURING METHOD, AND GAS PRODUCTION METHOD

(71) Applicant: National Institute of Advanced Industrial Science and Technology, Tokyo (JP)

(72) Inventors: Jun Yoneda, Sapporo (JP); Yusuke Jin, Sapporo (JP); Koji Yamada, Sapporo (JP); Hideki Minagawa, Sapporo (JP); Kazunori Shinjo, Sapporo (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 0 days.

(21) Appl. No.: 18/815,889

(22) Filed: Aug. 27, 2024

(65) Prior Publication Data

US 2024/0418052 A1 Dec. 19, 2024

Related U.S. Application Data

(63) Continuation of application No. PCT/JP2023/006952, filed on Feb. 27, 2023.

(30) Foreign Application Priority Data

Feb. 28, 2022 (JP) ..... 2022-030057

(51) Int. Cl.
*E21B 33/138* (2006.01)

(52) U.S. Cl.
CPC ..... *E21B 33/138* (2013.01)

(58) Field of Classification Search
CPC ..... E21B 33/138; E21B 43/00; E21B 43/16
See application file for complete search history.

(56) References Cited

U.S. PATENT DOCUMENTS 7,931,091 B2 4/2011 Bailey et al.
9,556,541 B2 * 1/2017 Berrigan ..... C09K 8/70
(Continued)

FOREIGN PATENT DOCUMENTS

JP 2018-048522 A 3/2018
JP 2019-011612 A 1/2019
WO 2020/003551 A1 1/2020

OTHER PUBLICATIONS

International Search Report and Written Opinion mailed on Mar. 28, 2023, received for PCT Application PCT/JP2023/006952, filed on Feb. 27, 2023, 8 pages including English Translation.
(Continued)

*Primary Examiner* — Catherine Loikith
(74) *Attorney, Agent, or Firm* — XSENSUS LLP

(57) ABSTRACT

A joint assembly that selectively isolates an isolation target layer in an open hole drilled in the strata including a hydrocarbon-bearing reservoir and the isolation target layer, and is a production well manufacturing method and gas production method using the joint assembly. The joint assembly includes a tubular body to be inserted into the open hole to be positioned to penetrate the isolation target layer; and a light source disposed over entire circumference of an outer periphery of the body and configured to emit light to cure uncured photo-curable resin that is introduced between the body and a borehole wall of the open hole.

15 Claims, 18 Drawing Sheets

(56) References Cited

U.S. PATENT DOCUMENTS

| | | | | |
|---|---|---|---|---|
| 9,784,072 | B2 * | 10/2017 | Belakshe | C09K 8/524 |
| 10,865,620 | B1 | 12/2020 | Ramasamy et al. | |
| 2020/0123885 | A1 | 4/2020 | Yamamoto et al. | |
| 2020/0300403 | A1 * | 9/2020 | Taylor | F16L 55/1651 |
| 2021/0222536 | A1 | 7/2021 | Liu et al. | |
| 2021/0238953 | A1 | 8/2021 | Boul et al. | |

OTHER PUBLICATIONS

Koji Yamamoto, "Second Offshore Production Test", Methane Hydrate Forum 2017, Available Online at: https://www.mh21japan.gr.jp/mh21wp/wpcontent/uploads/mh21form2017_doc021.pdf, Nov. 29, 2017, (63 pages including Partial English Translation).

"Comprehensive Report of Phase 2 & 3 Research Results", Japan's Methane Hydrate R&D Program, Research Consortium for Methane Hydrate Resources in Japan, Feb. 2019, pp. 1-43.

* cited by examiner

JOINT ASSEMBLY, PRODUCTION WELL MANUFACTURING METHOD, AND GAS PRODUCTION METHOD

CROSS-REFERENCE TO RELATED APPLICATIONS

The present application is a continuation application of PCT International Application No. PCT/JP2023/006952 filed on Feb. 27, 2023, designating the United States of America, which is based on and claims priority to Japanese patent application JP 2022-030057, filed Feb. 28, 2022. The entire disclosures of the above-identified applications, including the specifications, the drawings, and the claims are incorporated herein by reference in their entirety.

TECHNICAL FIELD

The present disclosure relates to joint assemblies, production well manufacturing methods, and gas production methods.

BACKGROUND

Conventional techniques to yield methane hydrate have problems including the production of sand and water. Non Patent Literature 1, for example, describes measures for counteracting these problems. To avoid the compaction of the reservoir and the production of sand during the production of methane hydrate, Patent Literature 1 describes a yielding method of methane hydrate from a sand reservoir, and the method includes injecting a grouting agent, which is capable of sufficiently fixing sand particles, into a gap (pore space) of unsolidified or weakly solidified sand reservoir to be developed.

Patent Literature 2 describes a hydrocarbon collection method that is characterized by a composition used to prevent earth and sand contained in the seabed from flowing into a production well. Specifically, this hydrocarbon collection method uses a composition that is used by microorganisms that generate carbon dioxide or sulfate ions to promote deposition of calcium carbonate when they generate carbon dioxide or sulfate ions.

Patent Literature 3 discloses a process for lining an open hole and a tool for producing a coating for open hole. This tool is attached to a drill bit at a tip of a drill string and has multiple injectors and emitters around a portion of a circumferential surface. A fluid composition is supplied from the injectors to an outer periphery of the tool and is cured by light emitted from the emitters to produce an open-hole coating.

Patent Literature 4 discloses a method and system for sealing a casing to an open hole by photoactivation. This method is used for cementing a casing in an open hole, and includes inserting an optical fiber cable attached to the outside of the casing into the open hole, and activating a sealant via the optical fiber within the open hole, thus curing the sealant by the reaction.

Patent Literature 5 discloses a method for sealing a lost circulation zone, such as cavities, which become obstacles when drilling a subterranean well. In this method, a drill string has an ultraviolet (UV) system, an actuator, and a fluid flow path, and the method includes delivering a UV curable material into the fluid flow path of the drill string during drilling of a subterranean well, and applying UV light to the fluid flow path of the drill string from the UV system. This feeds the activated UV curable material through the fluid flow path of the drill string into the lost circulation zone, where the UV curable material cures to fill the voids.

PATENT LITERATURE

Patent Literature 1: WO2020/003551
Patent Literature 2: JP 2019-11612 A
Patent Literature 3: U.S. Pat. No. 7,931,091 B2
Patent Literature 4: US 2021/0238953 A1
Patent Literature 5: U.S. Pat. No. 10,865,620 B1

NON PATENT LITERATURE

Non Patent Literature 1: Koji Yamamoto, "About the Second Offshore Production Test", [online], Nov. 29, 2017, Methane Hydrate Forum 2017, [Retrieved Feb. 2, 2022]

The methane hydrate production method of Patent Literature 1 installs a casing in a drilled hole and applies cementing to the gap between the borehole wall and the casing. In addition, through holes are formed between the casing and cementing by gun perforation, thus enabling a material exchange between the reservoir and the inside of the mine. Although this production method provides excellent mechanical stability for the production well, it not only increases the construction costs of the production well, but also reduces the gas production efficiency, compared to an open hole without a casing. The same applies to the methods of Patent Literatures 2 and 4 that use a casing.

To cure the fluid composition over the entire circumference of the borehole wall of the open hole, the tool for producing a coating for open hole in Patent Literature 3 requires rotation of the tool having emitters on part of the circumferential surface in a circumferential direction. However, the rotation of the tool may be hindered by the partially cured fluid composition. It is also not practical to cure the fluid composition, which is supplied from the injectors to the outer periphery of the tool, by the light irradiated from the emitters from the borehole wall side without allowing it to settle in the open hole. The method of Patent Literature 5 includes irradiating the UV curable material in the fluid flow path of the drill string with UV light for activation, and then feeding the UV material into cavities of the strata to allow it to cure. The feasibility of this method, however, is questionable.

SUMMARY

The present disclosure provides a joint assembly that selectively isolates an isolation target layer in an open hole drilled in the strata including a hydrocarbon-bearing reservoir and the isolation target layer, and provides a production well manufacturing method and gas production method using the joint assembly.

A joint assembly according to one aspect of the present disclosure is used in an open hole drilled in strata including a hydrocarbon-bearing reservoir and an isolation target layer and is configured to selectively isolate the isolation target layer. The joint assembly includes: a tubular body to be inserted into the open hole to be positioned to penetrate the isolation target layer; and a light source disposed over entire circumference of an outer periphery of the body and configured to emit light to cure uncured photo-curable resin that is introduced between the body and a borehole wall of the open hole.

The joint assembly according to the above aspect of the present disclosure is used having the tubular body inserted into the open hole to be placed at a position penetrating the isolation target layer in the strata and then introducing uncured photo-curable resin between the body and the borehole wall of the open hole. The joint assembly in this state lets the light source, which is placed over the entire circumference of an outer periphery of the body, emit light to cure the photo-curable resin. This allows the annular or cylindrical photo-curable resin cured between the body and the borehole wall of the open hole to cover the borehole wall of the open hole at a portion that penetrates the isolation target layer of the open hole, thus enabling selective isolation of the isolation target layer from the open hole.

The joint assembly according to the above aspect of the present disclosure may further include an actuator configured to contract the outer periphery from an expanded position outside in the radial direction of the body to a contracted position inside in the radial direction.

The joint assembly according to this aspect allows, in response to the operation of the actuator, to contract the outer periphery of the body from an expanded position outside in the radial direction of the body to a contracted position inside in the radial direction. This allows the outer circumferential surface of the outer periphery of the body to be separated from the inner circumferential surface of the cured photo-curable resin covering the borehole wall of the open hole at the part penetrating the isolation target layer, and thus enables the removal of the body from the open hole having the isolation target layer separated by the cured photo-curable resin.

The joint assembly according to the above aspect of the present disclosure may further include an anti-adhesion layer on the outer surface of the body, the anti-adhesion layer preventing adhesion of the photo-curable resin after curing and the body.

The joint assembly according to this aspect lets the light source emit light to the uncured photo-curable resin through the light-transmissive anti-adhesion layer placed on the outer surface of the body, so that the photo-curable resin cures while being in contact with the anti-adhesion layer. Thus, the anti-adhesion layer prevents the cured photo-curable resin from adhering to the outer surface of the body, and when the actuator is operated to contract the outer periphery of the body radially inward, the outer circumferential surface of the outer periphery is easily separated from the inner circumferential surface of the cured photo-curable resin.

A production well manufacturing method according to one aspect of the present disclosure includes: drilling the open hole into the strata; locating the hydrocarbon-bearing reservoir and the isolation target layer in the strata; inserting the body into the open hole to place the body at a position penetrating the isolation target layer; introducing the uncured photo-curable resin between the body and the borehole wall of the open hole; emitting the light from the light source to cure the uncured photo-curable resin between the body and the borehole wall of the open hole over the entire circumference of the body, thus forming a production well having the isolation target layer of the open hole selectively isolated by the cured photo-curable resin; and collecting the uncured photo-curable resin and remains in a portion of the open hole where the hydrocarbon-bearing reservoir is exposed.

The production well manufacturing method according to the above aspect of the present disclosure allows the drilling of an open hole into strata that contains a hydrocarbon-bearing reservoir and an isolation target layer, and the locating of the hydrocarbon-bearing reservoir and the isolation target layer in the strata. Then, the method inserts the body of the joint assembly according to the above aspect into the open hole to be placed at a position penetrating the isolation target layer in the strata, and emits light from the light source placed over the entire circumference of the outer periphery of the body to uncured photo-curable resin that is introduced between the body and the borehole wall of the open hole. This selectively cures the uncured photo-curable resin, which is in contact with the isolation target layer exposed to the borehole wall of the open hole, over the entire circumference of the borehole wall, thus forming a production well having the isolation target layer selectively isolated from the open hole by the cured photo-curable resin. After that, the method collects uncured photo-curable resin that remains in the portion of the open hole where the hydrocarbon-bearing reservoir is exposed, thereby manufacturing a production well that is capable of yielding hydrocarbon from the hydrocarbon-bearing reservoir selectively exposed to the borehole wall of the open hole.

In the production well manufacturing method according to the above aspect, the production well may be formed while leaving the uncured photo-curable resin above the cured photocurable resin.

Although the cured photo-curable resin may contract and create a gap between the borehole wall of the open hole and the cured photo-curable resin, the uncured photo-curable resin remaining above the cured photo-curable resin will flow into the gap and cure to fill the gap. This prevents the formation of a gap between the cured photo-curable resin and the isolation target layer exposed to the borehole wall of the open hole, thereby isolating the isolation target layer from the open hole more reliably.

In the production well manufacturing method according to the above aspect, the hydrocarbon-bearing reservoir may include a gas hydrate-bearing layer, and the isolation target layer may include a water-bearing layer.

The manufacturing method of this aspect allows the drilling of an open hole into strata that contains a gas hydrate-bearing layer that bears hydrocarbon such as methane hydrate and a water-bearing layer to form a production well having the water-bearing layer selectively isolated from the open hole. Therefore, the method manufactures a production well that is capable of efficiently producing hydrocarbon gas such as methane gas from the gas hydrate-bearing layer selectively exposed to the borehole wall of the open hole.

A gas production method according to another aspect of the present disclosure includes the production well manufacturing method according to the above aspect, and the method includes following the collecting of the uncured photo-curable resin, reducing pressure of the production well to collect gas released from the gas hydrate-bearing layer to the production well.

The gas production method according to the above aspect of the present disclosure uses the production well having the water-bearing layer exposed to the borehole wall of the open hole and selectively isolated, and being capable of efficiently producing hydrocarbon gas such as methane gas from the gas hydrate-bearing layer selectively exposed to the borehole wall of the open hole, thus efficiently producing the gas by the depressurization method.

The above aspects of the present disclosure provide a joint assembly that selectively isolates an isolation target layer in an open hole drilled in the strata including a hydrocarbon-bearing reservoir and the isolation target layer, and provides a production well manufacturing method and gas production method using the joint assembly.

DESCRIPTION OF EMBODIMENTS

Embodiment 1

Referring to FIG. 1 through FIG. 10, the following describes a joint assembly, production well manufacturing method, and gas production method that is Embodiment 1 according to the present disclosure.

Figure 1:
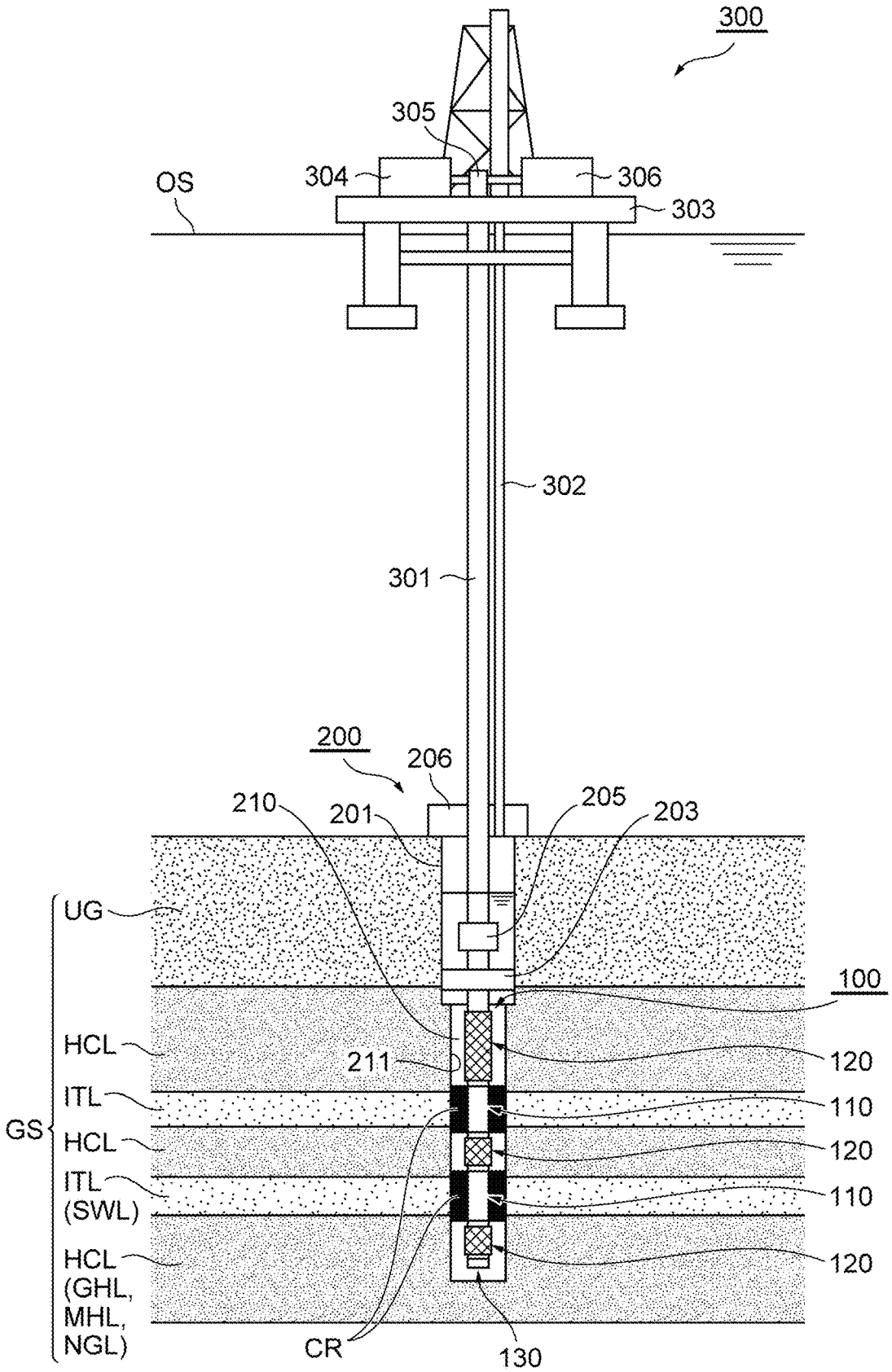
FIG. 1 is a schematic cross-sectional view showing a joint assembly that is Embodiment 1 according to the present disclosure.
Figure 2:
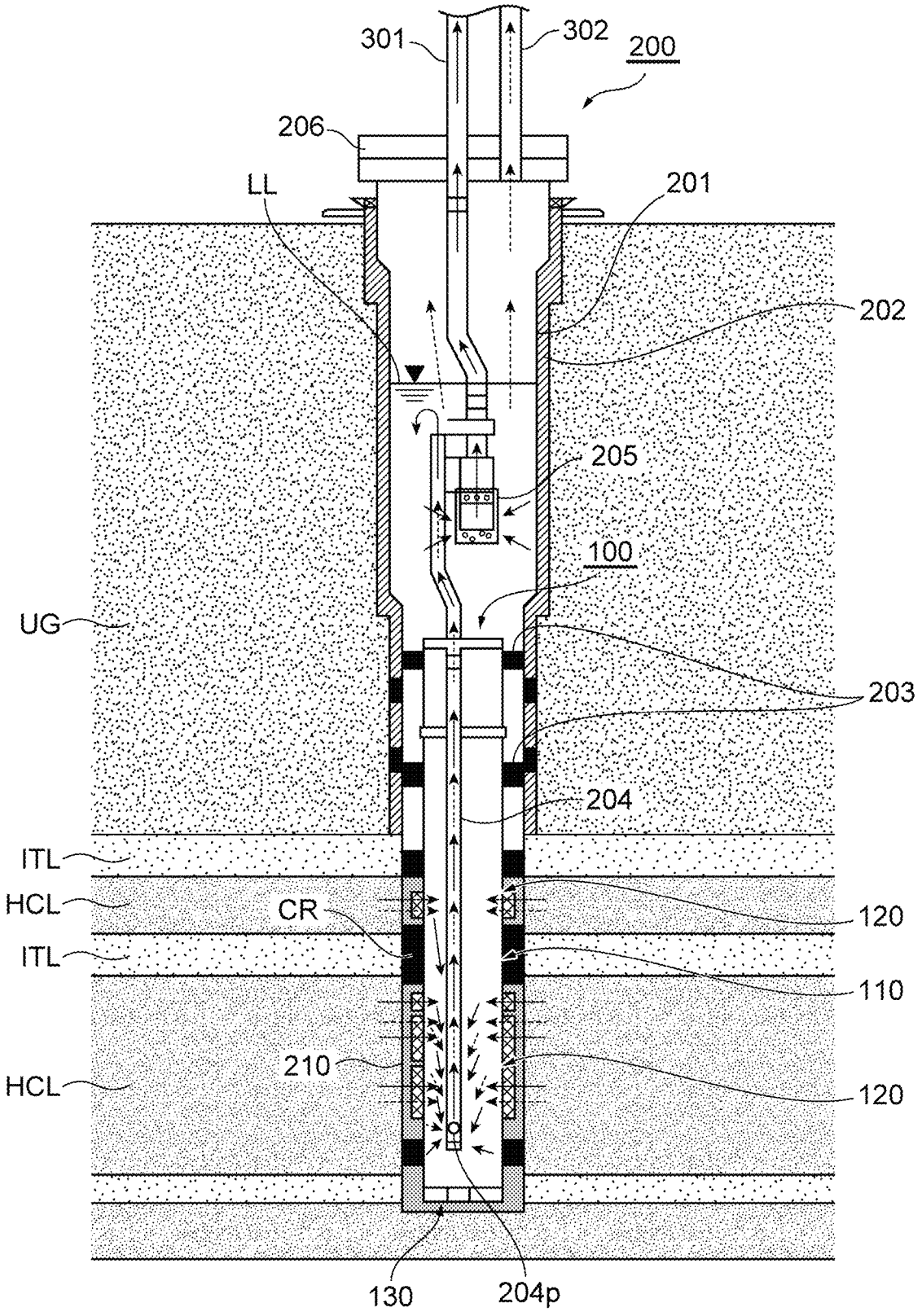
FIG. 2 is a schematic enlarged cross-sectional view of a production well, into which a joint assembly shown in FIG. 1 is inserted.

FIG. 1 is a schematic cross-sectional view showing a joint assembly that is Embodiment 1 according to the present disclosure. FIG. 2 is a schematic enlarged cross-sectional view of a production well 200, into which a sand control assembly 100 including the joint assembly 110 shown in FIG. 1 is inserted.

The joint assembly 110 of this embodiment is inserted into an open hole 210 drilled into strata GS including a hydrocarbon-bearing reservoir HCL and an isolation target layer ITL. The joint assembly 110 is configured to selectively isolate the isolation target layer ITL exposed to the borehole wall 211 of the open hole 210 by cured photo-curable resin CR. The open hole 210 refers to a portion of the production well 200 drilled in the strata GS where the casing 201 is not inserted.

For instance, the strata GS having the production well 200 drilled therein is seabed strata at a depth of 500 m or more, and includes an upper ground layer UG including the seabed surface, and hydrocarbon-bearing reservoirs HCL and isolation target layers ITL that are deposited alternately below the upper ground layer UG. The production well 200 has a part penetrating the upper ground layer UG, and a casing 201 is inserted in this part. The lower part of the production well 200 below the upper ground layer UG is the open hole 210, where the casing 201 is not inserted. That is, the strata GS through which the open hole 210 is drilled includes the hydrocarbon-bearing reservoirs HCL and the isolation target layers ITL.

Each hydrocarbon-bearing reservoir HCL is a gas hydrate-bearing layer GHL that bears a hydrocarbon gas, for example. Each gas hydrate-bearing layer GHL is a methane hydrate-bearing layer MHL or natural gas hydrate-bearing layer NGL, for example. Each isolation target layer ITL is a water-bearing layer SWL, for example. The strata GS through which the open hole 210 is drilled is not limited to seabed strata, and may be land strata containing permafrost, for example. In this embodiment, each hydrocarbon-bearing reservoir HCL is a methane hydrate-bearing layer MHL, and each isolation target layer ITL is a water-bearing layer SWL.

For instance, tubular joint assemblies 110 are alternately connected with tubular sand filters 120 to configure a tubular sand control assembly (SCA) 100 that extends from the upper end to the bottom of the open hole 210. That is, the sand control assembly 100 includes a plurality of joint assemblies 110 and a plurality of sand filters 120 that are connected in a straight line in the depth direction of the open hole 210 and is inserted and installed in the open hole 210.

The sand control assembly 100 is configured so that one or more joint assemblies 110 are each placed at a position of the corresponding isolation target layer ITL and one or more sand filters 120 are each placed at a position of the corresponding hydrocarbon-bearing reservoir HCL, these joint assemblies 110 and sand filters 120 being alternately connected in the depth direction of the open hole 210.

In other words, when being inserted and installed in the open hole 210, the sand control assembly 100 has one or more joint assemblies 110 at overlapping positions with their corresponding isolation target layers ITL, and one or more sand filters 120 at overlapping positions with their corresponding hydrocarbon-bearing reservoirs HCL. The joint assemblies 110 and the sand filters 120 may be prepared in several different lengths in accordance with the thicknesses of the isolation target layers ITL and of the hydrocarbon-bearing reservoirs HCL, respectively.

For instance, as shown in FIGS. 1 and 2, the upper end of the sand control assembly 100 is supported via a packer 203 inside a casing 201 fixed with cement 202 to the portion of the production well 200 that penetrates the upper ground layer UG. For instance, as shown in FIG. 2, the tubular sand control assembly 100 has an inner tubing 204 inserted therein. For instance, the inner tubing 204 extends from below the liquid level LL inside the casing 201 to the inside of the tip of the sand control assembly 100 located at the bottom of the open hole 210, and has a perforation 204*p* that opens into the inside of the tip of the sand control assembly 100.

A pump 205 is placed below the liquid level LL inside the casing 201. The pump 205 is connected to a water production tube 301 that extends above sea surface OS. When the water in the casing 201 is pumped up by the pump 205 to a floating production facility 300 above the sea surface OS, the open hole 210 is depressurized so that decomposition of methane hydrate is accelerated in the methane hydrate bearing layer MHL that is a hydrocarbon-bearing reservoir HCL near the open hole 210, and methane gas, together with water, flows into the sand control assembly 100 through the sand filter 120.

The water and methane gas flowing into the sand control assembly 100 inserted into the open hole 210 flows into the perforation 204*p* at the tip of the inner tubing 204 inserted into the sand control assembly 100, and rises within the inner tubing 204 to flow out into the casing 201 fixed to the upper end of the production well 200. The water and methane gas that flow into the casing 201 are separated into gas and liquid within the casing 201.

A blow out protection (BOP) 206, installed at the upper end of the casing 201 above the seabed surface, has the water production tube 301 passing therethrough to extend to the floating production facility 300 at the sea surface OS. The BOP 206 also has a gas production tube 302 attached thereto, which communicates with the space above the liquid level LL within the casing 201 and extends to the floating production facility 300. For instance, the floating production facility 300 includes a platform 303 floating above the sea surface OS, a produced water tank 304 on the platform 303, a switching device 305, and a photocurable-resin tank 306.

Figure 3:
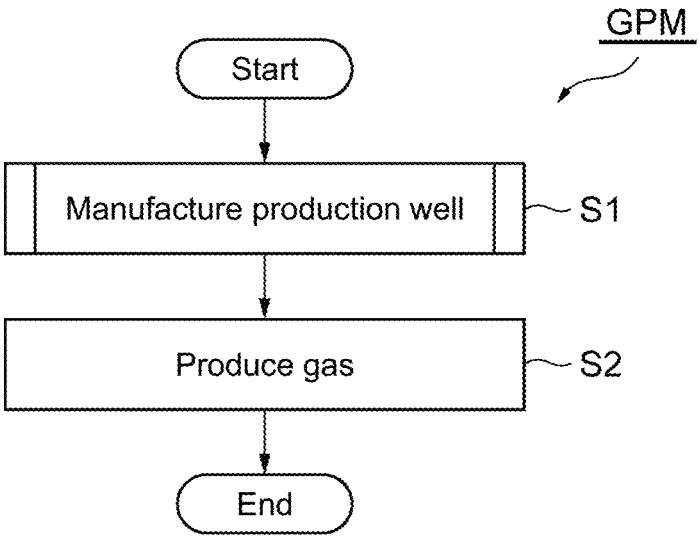
FIG. 3 is a flowchart showing a gas production method that is Embodiment 1 of the present disclosure.
Figure 4:
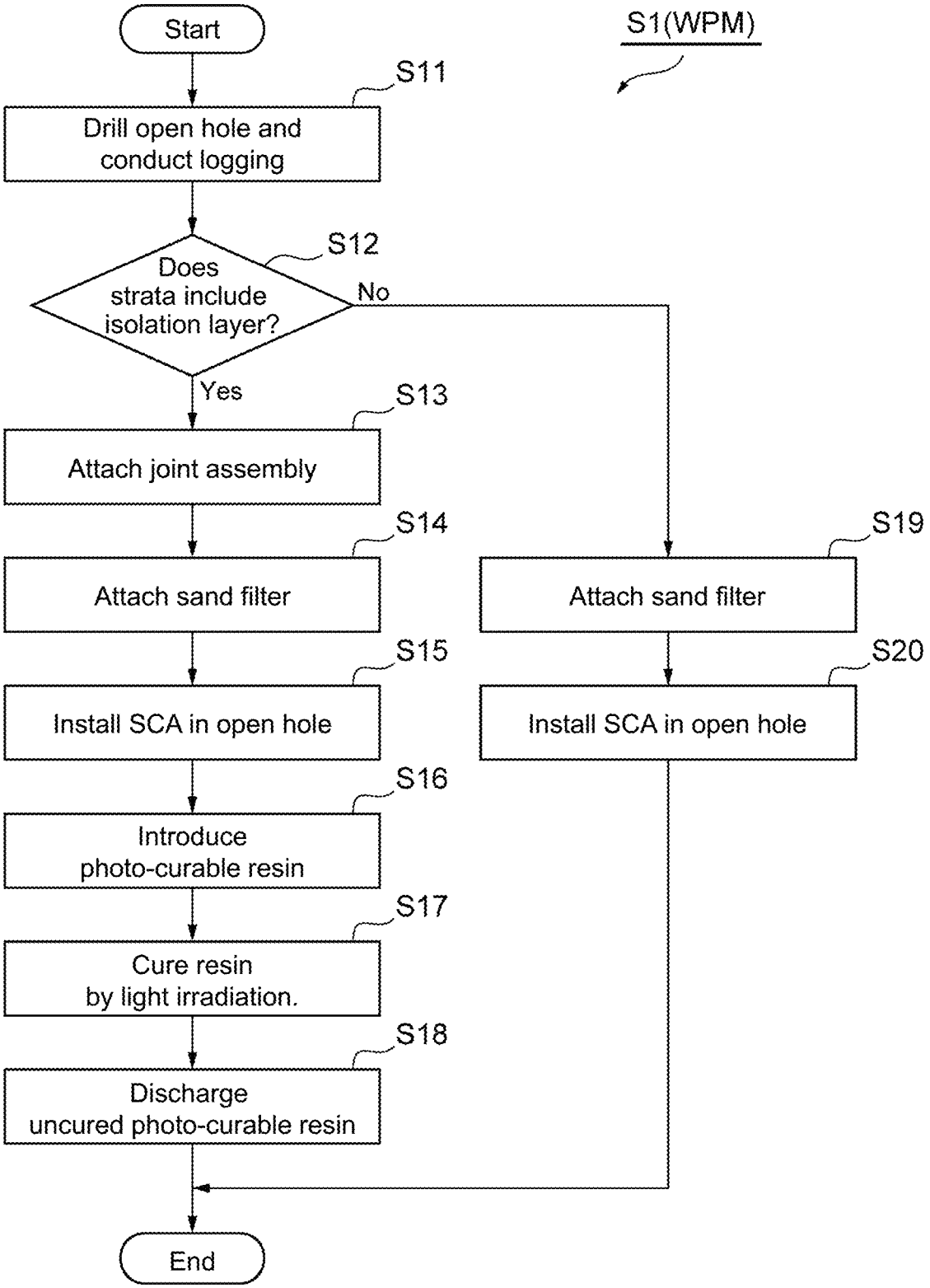
FIG. 4 is a flowchart showing a production well manufacturing method that is Embodiment 1 of the present disclosure.

FIG. 3 is a flowchart showing a gas production method that is Embodiment 1 of the present disclosure. FIG. 4 is a flowchart showing a production well manufacturing method that is Embodiment 1 of the present disclosure.

The gas production method GPM of this embodiment shown in FIG. 3 includes step S1 of manufacturing a production well, and step S2 of producing gas from the production well manufactured in step S1. In step S1 of manufacturing a production well, a production well 200 is manufactured by the production well manufacturing method WPM of this embodiment shown in FIG. 4 using the joint assembly 110 shown in FIGS. 1 and 2.

In step S1 shown in FIG. 4, the production well manufacturing method WPM of this embodiment starts with drilling an open hole and logging step S11. In this step S11, a step of drilling an open hole 210 in the strata GS and a step of specifying the positions, that is, depths, of the hydrocarbon-bearing reservoirs HCL and isolation target layers ITL in the strata GS are performed simultaneously, for example.

Figure 5:
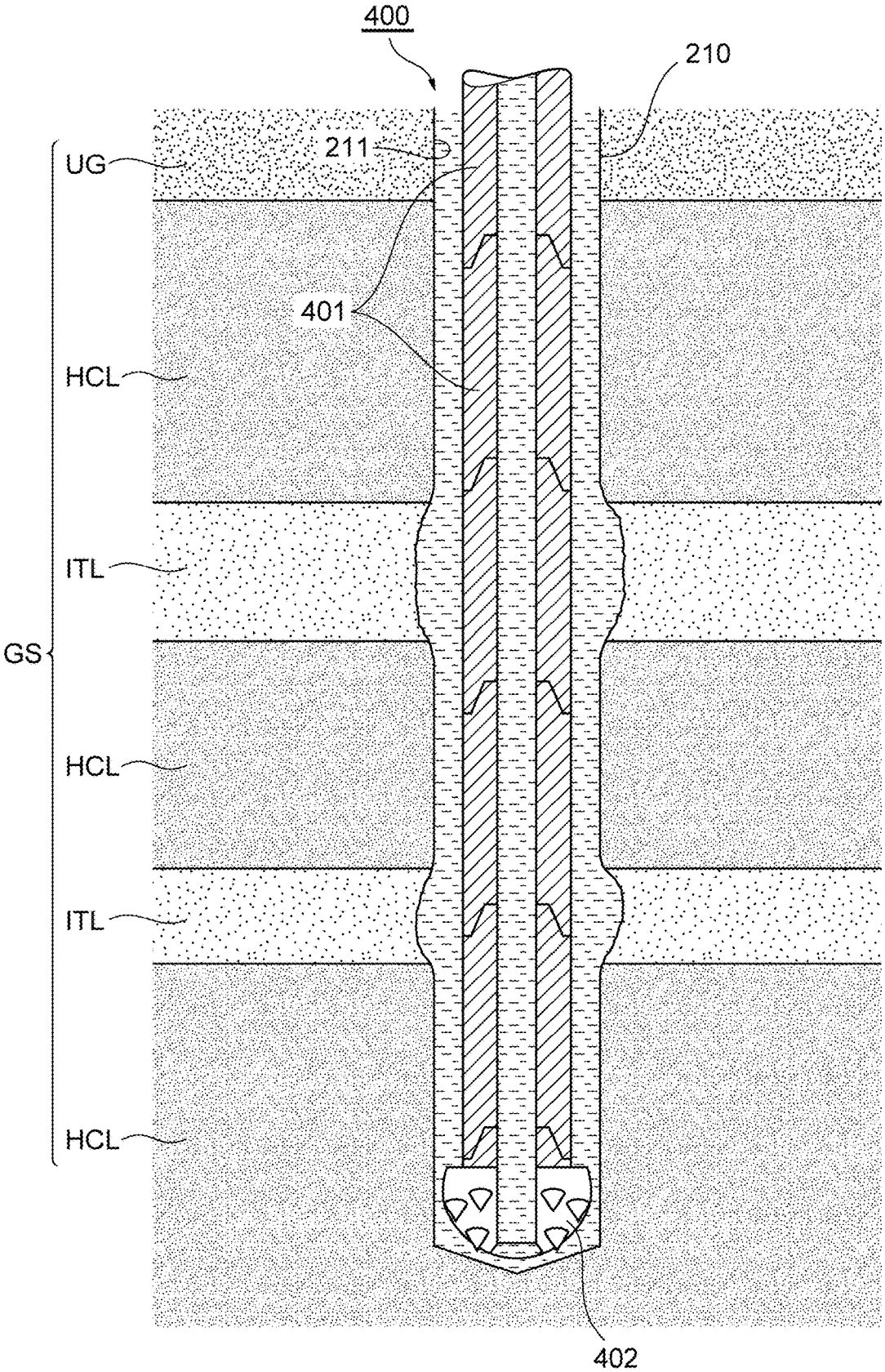
FIG. 5 is a schematic enlarged cross-sectional view illustrating the open-hole drilling and logging step in FIG. 4.

FIG. 5 is a schematic enlarged cross-sectional view illustrating the open-hole drilling and logging step S11 in FIG. 4. In this open-hole drilling and logging step S11, an open hole 210 is drilled in the strata GS using a bottom hole assembly 400, for example. For instance, the bottom hole assembly 400 includes a plurality of tubular drill pipes 401 that are connectable in a straight line, and a drill bit 402 attached to the tip of the drill pipes 401 to drill the strata GS.

In the open-hole drilling and logging step S11, while the bottom hole assembly 400 is rotated, seawater or drilling mud is supplied for circulation to the tip of the drill bit 402 through the drill pipes 401 to drill the open hole 210 in the strata GS. Another drill pipe 401 will be connected as the drilling of the open hole 210 progresses. The open-hole drilling and logging step S11 may include a step of installing a casing 201 at the upper end of the open hole 210.

In the open-hole drilling and logging step S11, logging is also performed simultaneously with drilling of the strata GS using a physical logging method such as logging while drilling (LWD) and measurement while drilling (MWD). Drilling and logging of the open hole may be performed sequentially. In this case, wireline logging may follow the drilling of the open hole. These logging techniques accurately specify the position, i.e., depth, of each of the hydrocarbon-bearing reservoirs HCL and isolation target layers ITL in the depth direction of the open hole 210.

After the completion of the open-hole drilling and logging step S11, the bottom hole assembly 400 is extracted from the open hole 210. Then, step S12 is performed to determine whether or not the strata GS having the open hole 210 drilled contains any isolation target layer ITL, such as a water-bearing layer SWL. If it is determined in step S12 that the strata GS includes an isolation target layer ITL (YES), step S13 of attaching a joint assembly 110 to the sand control assembly 100 and step S14 of attaching a sand filter 120 are performed. Then, step S15 is performed to install the sand control assembly (SCA) 100 in the open hole 210.

Figure 6:
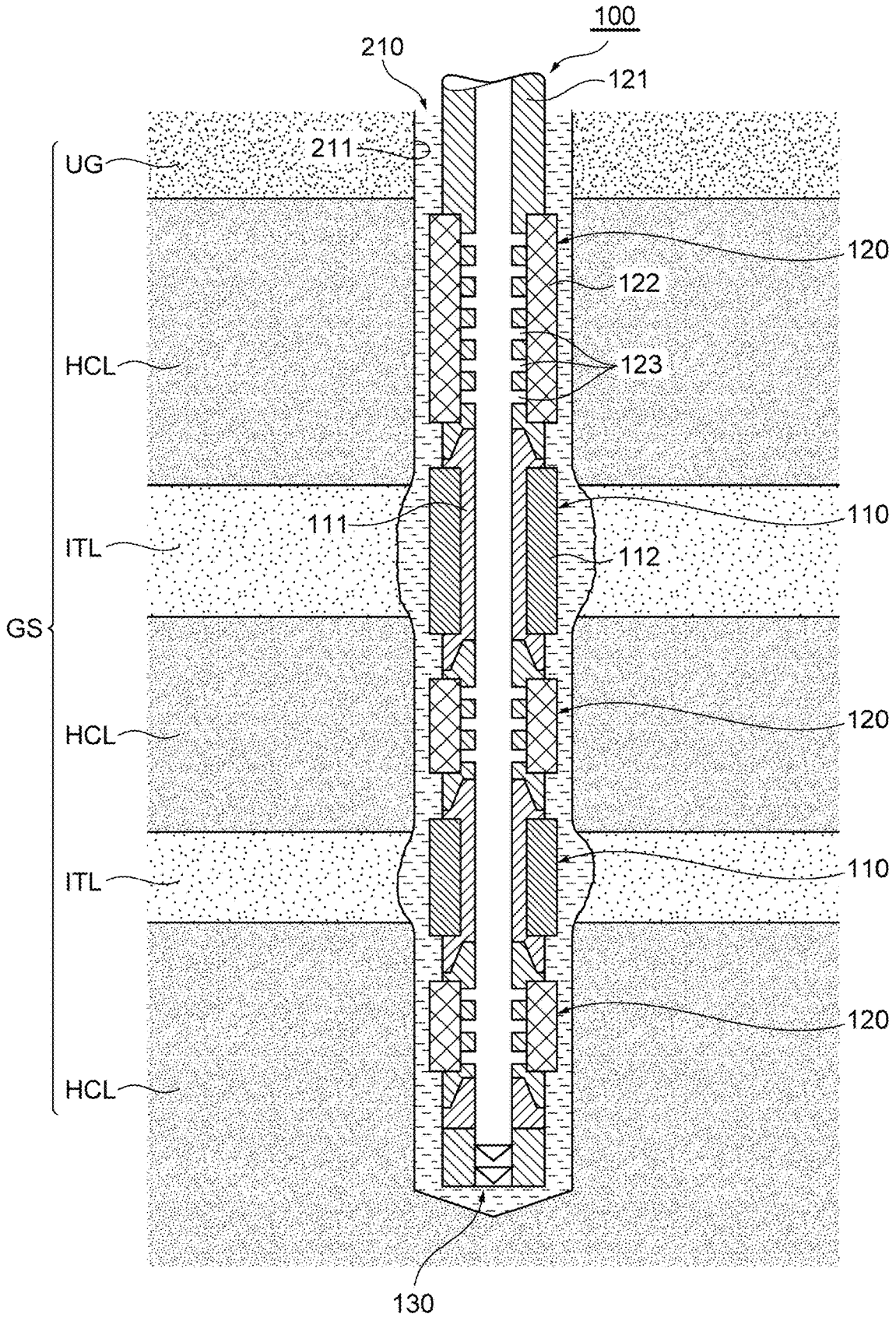
FIG. 6 is a schematic enlarged cross-sectional view after the sand control assembly (SCA) in FIG. 4 has been installed.

FIG. 6 is a schematic enlarged cross-sectional view after the completion of step S15, that is, after the sand control assembly (SCA) 100 has been installed in the open hole 210. As shown in FIG. 6, the sand control assembly 100 in one example includes one or more joint assemblies 110 and one or more sand filters 120 that are alternately connected, and has a check valve 130 attached at the tip. The check valve 130 allows fluid to flow from a flow path within the sand control assembly 100 into the open hole 210 and blocks fluid flow from the open hole 210 to the flow path within the sand control assembly 100.

The tubular joint assemblies 110 are inserted into the open hole 210 to be each positioned to penetrate the corresponding isolation target layer ITL. That is, each joint assembly 110 is installed at the position or depth of the corresponding isolation target layer ITL in the depth direction of the open hole 210. Each of the tubular sand filters 120 is installed at the position or depth of the corresponding hydrocarbon-bearing reservoir HCL in the depth direction of the open hole 210.

Each joint assembly 110 has a tubular body 111 that is inserted into the open hole 210 to be positioned to penetrate the isolation target layer ITL, and a luminescence device 112 that is placed around the entire perimeter of the body 111. Each sand filter 120 has a tubular body 121 similar to the bodies 111 of the joint assemblies 110, and a filter 122 around the periphery of the body 121.

Each sand filter 120 has a plurality of through holes 123 penetrating the wall of the body 121. The flow path inside the sand filter 120 communicates with the open hole 210 surrounding the sand filter 120 via the through holes 123 and a filter 122. For instance, the sand filters 120 may be a commercially available sand filter such as EXCLUDER2000 manufactured by Baker Hughes, Inc. or GeoFORM.

Figure 7:
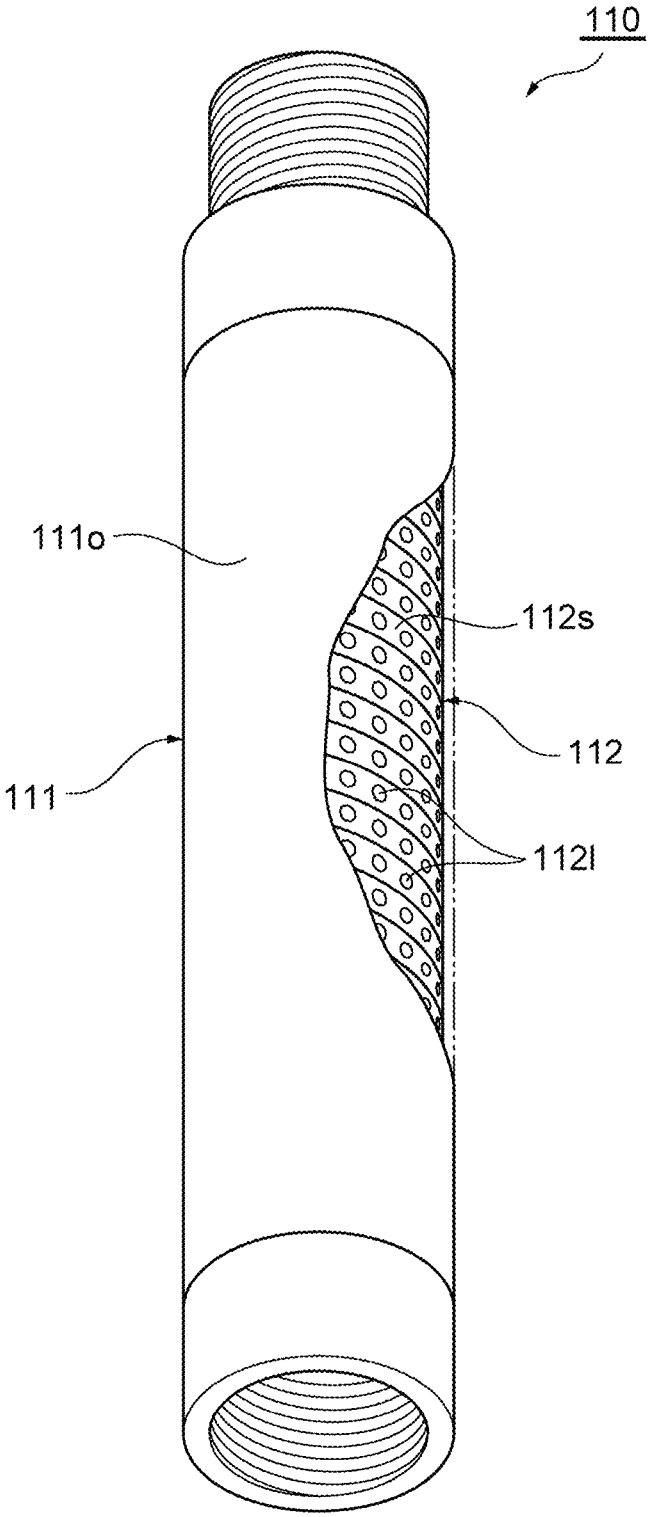
FIG. 7 is a perspective view of one example of a joint assembly that makes up the SCA of FIG. 6.

FIG. 7 is a perspective view of one example of a joint assembly 110 that makes up the sand control assembly (SCA) 100 of FIG. 6. As described above, the joint assembly 110 includes the tubular body 111 and the luminescence device 112 placed around the entire perimeter of the outer periphery 111*o* of the body 111. For instance, the body 111 is a tubular member having a cylindrical flow path therein, and has openings at one and the other ends in the longitudinal direction.

For instance, the body 111 has an external thread on the outer circumferential surface at one end in the longitudinal direction, and an internal thread on the inner circumferential surface at the other end in the longitudinal direction. This allows the plurality of joint assemblies 110 to be connected in a straight line in the axial direction. For instance, the body 111 is a double tube having an outer tube and an inner tube, and the outer tube is made of a material such as acrylic having translucency that allows the light emitted from the luminescence device 112 to pass through. The luminescence device 112 is placed between the outer tube and the inner tube on the outer periphery 111*o* of the body 111, around the entire perimeter of the outer periphery 111*o*.

For instance, the luminescence device 112 has a strip-shaped light emitting section 112*s* with a plurality of LEDs 112*l*. The strip-shaped light emitting section 112*s* is wound spirally around the outer circumferential surface of the inner tube of the body 111, for example. For instance, the luminescence device 112 has a battery and a switch built into one end of the outer periphery 111*o* of the body 111 to let the LEDs 112*l* of the light emitting section 112*s* emit light.

The luminescence device 112 emits light to cure uncured photo-curable resin LCR (see FIG. 8) that is introduced between the body 111 and the borehole wall 211 of the open hole 210. Specifically, the photo-curable resin LCR may be a UV-curing resin, and then the luminescence device 112 emits UV light from the plurality of LEDs 112*l* in the light emitting section 112*s* placed over the entire circumference of the outer periphery 111*o* of the body 111.

As shown in FIGS. 4 and 6, after the completion of step S15 of installing the sand control assembly (SCA) 100 in the open hole 210, step S16 is performed to introduce a photo-curable resin LCR into the open hole 210.

Figure 8:
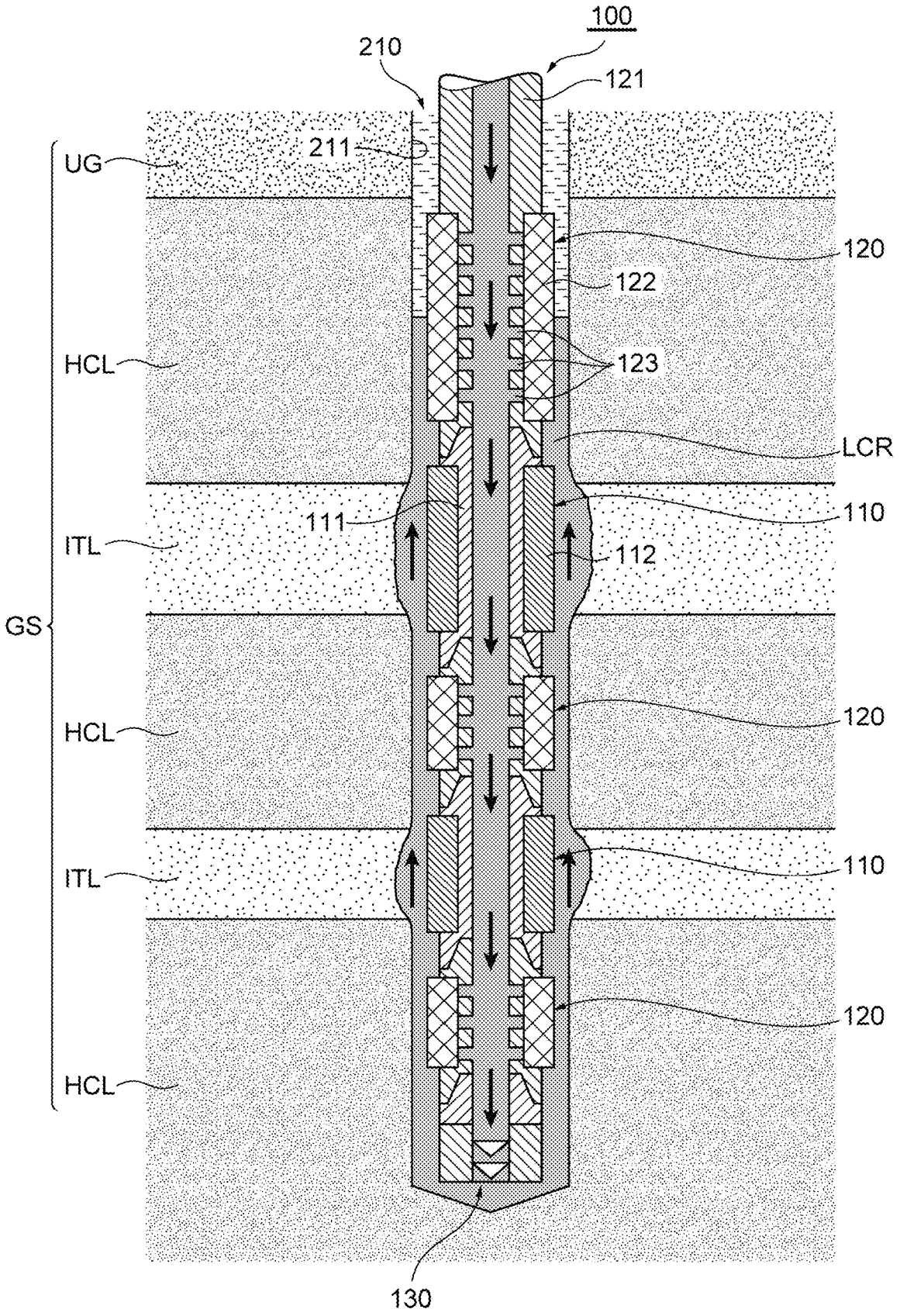
FIG. 8 is a schematic enlarged cross-sectional view illustrating a step of introducing a photo-curable resin in FIG. 4.

FIG. 8 is a schematic enlarged cross-sectional view illustrating step S16 of introducing a photo-curable resin LCR in FIG. 4. In this step S16, a photo-curable resin LCR is introduced between the body 111 of each joint assembly 110 and the borehole wall 211 of the open hole 210. Specifically, the switching device 305 of the floating production facility 300 shown in FIG. 1 is switched to supply the photo-curable resin LCR from the photo-curable resin tank 306 to the flow path inside the sand control assembly 100 through the water production tube 301.

This allows the photo-curable resin LCR to be discharged from the check valve 130 at the tip of the sand control assembly 100 to the bottom of the open hole 210. The photo-curable resin LCR, such as a UV curing resin, has a higher specific gravity than the fluid, such as seawater, in the open hole 210. Therefore, the uncured photo-curable resin LCR discharged from the check valve 130 at the tip of the sand control assembly 100 into the bottom of the open hole 210 gradually accumulates upward from the bottom of the open hole 210, filling the space between the body 111 of each joint assembly 110 and the borehole wall 211 of the open hole 210.

In this step S16 of introducing the photo-curable resin LCR, the supply of photo-curable resin LCR is continued until the photo-curable resin LCR is introduced between the bodies 111 of all joint assemblies 110 that constitute the sand control assembly 100 and the borehole wall 211 of the open hole 210. Thereafter, the supply of the photo-curable resin LCR from the photo-curable resin tank 306 to the sand control assembly 100 is stopped, and step S17 of curing the resin shown in FIG. 4 is performed by light irradiation.

Figure 9:
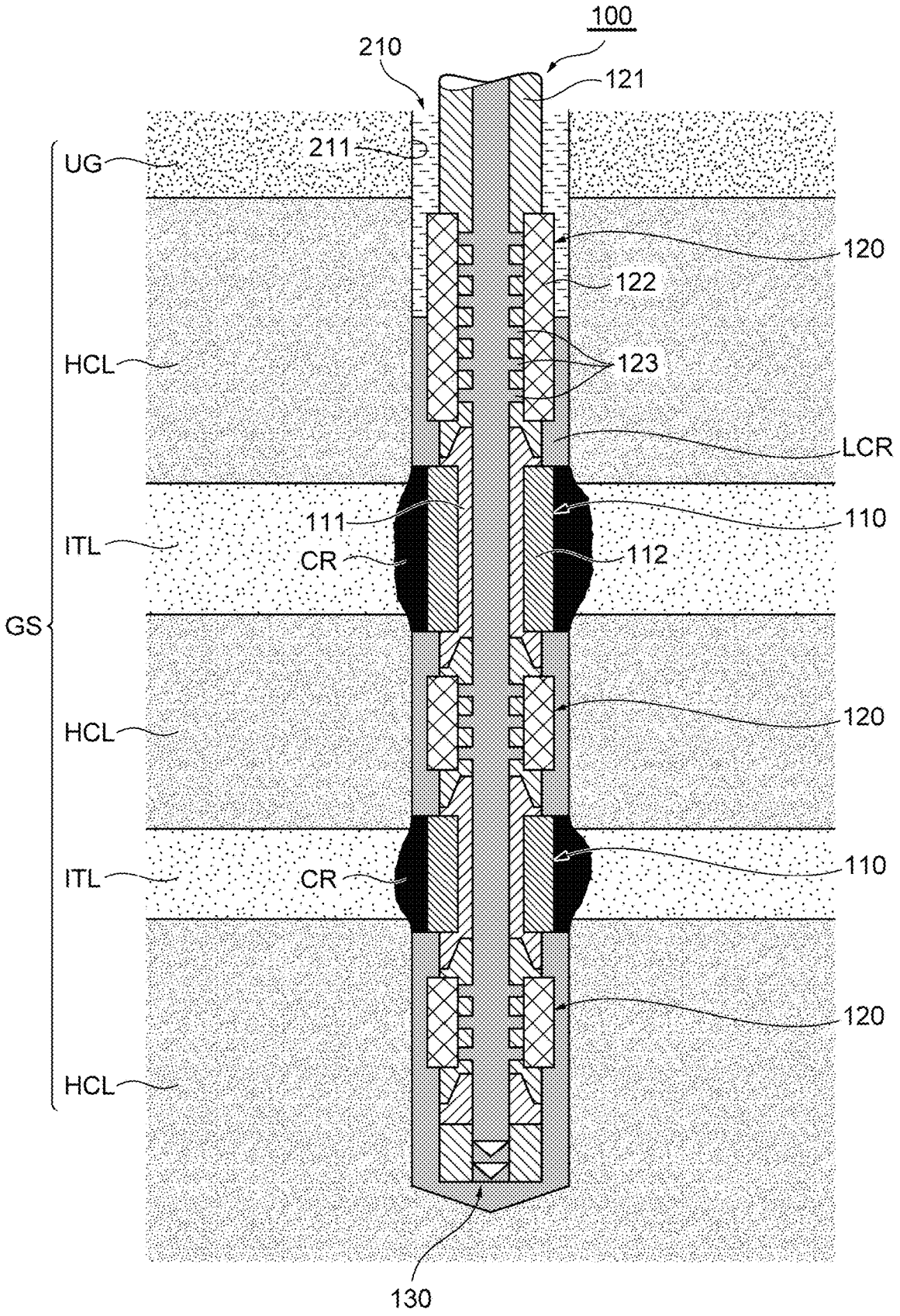
FIG. 9 is a schematic enlarged cross-sectional view illustrating the resin curing step by light irradiation in FIG. 4.

FIG. 9 is a schematic enlarged cross-sectional view illustrating the resin curing step S17 by light irradiation in FIG. 4. In this step S17, light is emitted from the luminescence device 112 of each joint assembly 110 to cure the uncured photo-curable resin LCR between the body 111 and the borehole wall 211 of the open hole 210 over the entire circumference of the body 111. This forms a production well 200 having the isolation target layers ITL of the open hole 210 that are isolated by the cured photo-curable resin CR.

Specifically, UV light is emitted from the plurality of LEDs 112*l* of the light emitting section 112*s* in the luminescence device 112 placed over the entire circumference of the outer periphery 111*o* of the body 111 of the joint assembly 110, for example. This cures the uncured UV-curing resin, the photo-curable resin LCR, between the body 111 and the borehole wall 211 of the open hole 210, so that the cured photo-curable resin CR covers the isolation target layers ITL exposed to the borehole wall 211 of the open hole 210.

As a result of the resin curing step S17 by light irradiation, a production well 200 is formed, having the isolation target layers ITL of the open hole 210 that are selectively isolated by the cured photo-curable resin CR. In the production well manufacturing method WPM of this embodiment, the resin curing process S17 is to form the production well 200 having the isolation target layers ITL selectively isolated by light irradiation. In this step, the photo-curable resin LCR still remains uncured above the cured photocurable resin CR.

Next, as shown in FIG. 4, step S18 is performed to discharge the uncured photo-curable resin LCR. In this step S18, for instance, the pump 205 in the casing 201 of the production well 200 shown in FIG. 2 is operated to pump up the uncured photo-curable resin LCR remaining in the flow path of the sand control assembly 100. This reduces the pressure in the flow path within the sand control assembly 100 below the pressure in the surrounding open hole 210.

This causes the uncured photo-curable resin LCR remaining in the portion of the open hole 210 where the hydrocarbon-bearing reservoirs HCL are exposed to flow into the internal flow path of the sand filters 120 through the filters 122 and multiple through holes 123 of the sand filters 120. The uncured photo-curable resin LCR that flows into the inner flow path of the sand filters 120 is then pumped up by the pump 205 in the casing 201 to be collected in the photo-curable resin tank 306 of the floating production facility 300 via the inner tubing 204 and water production tube 301, for example.

If it is determined that there is no isolation target layer ITL (NO) in step S12 that determines whether any isolation target layer ITL exists in FIG. 4, step S19 is performed to attach a sand filter 120 only to the sand control assembly 100 without attaching a joint assembly 110. Then, step S20 of installing the sand control assembly 100 in the open hole 210 is performed.

This completes step S1 of manufacturing the production well 200 shown in FIGS. 3 and 4. Thereafter, the gas production method GPM of this embodiment performs step S2 of producing gas as shown in FIG. 3. This step S2 includes, after step S18 of collecting the uncured photo-curable resin LCR in step S1 of manufacturing the production well 200, or step S20 of installing the sand control assembly 100 without the joint assembly 110 in the open hole 210, a step of reducing the pressure of the production well 200 to collect the gas released from the gas hydrate-bearing layer GHL to the production well 200.

Figure 10:
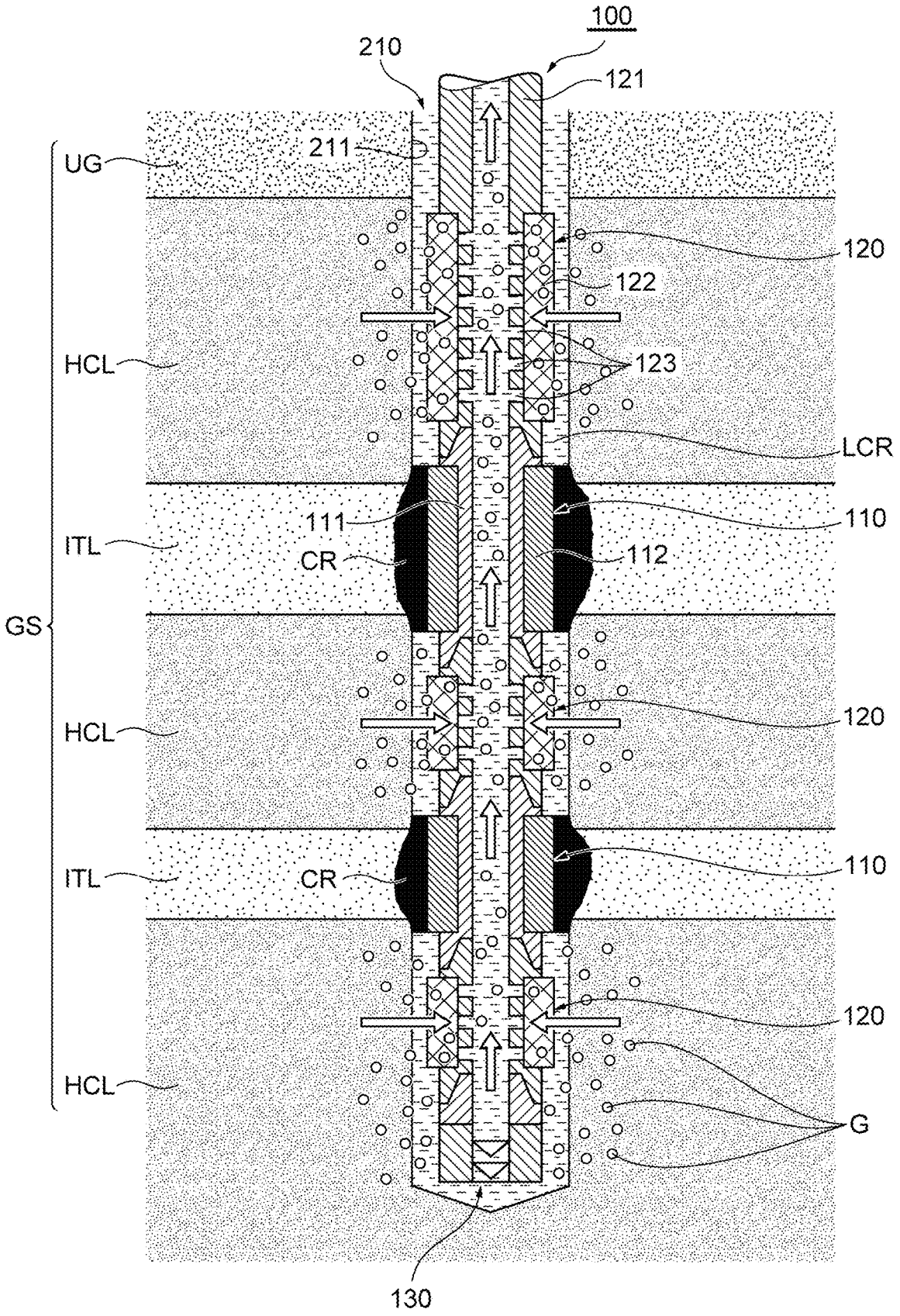
FIG. 10 is a schematic enlarged cross-sectional view illustrating a gas producing step in FIG. 3.

FIG. 10 is a schematic cross-sectional view illustrating the gas producing step S2 of FIG. 3. In this step S2, for instance, the pump 205 in the casing 201 of the production well 200 shown in FIG. 2 is operated to pump up liquid such as seawater or groundwater from a flow path of the sand control assembly 100. This reduces the pressure in the flow path within the sand control assembly 100 below the pressure in the surrounding open hole 210, so that seawater and groundwater flow from the open hole 210 into the flow path of the sand control assembly 100 via the filters 122 and the plurality of through holes 123 of the sand filters 120.

This reduces the pressure in the open hole 210 around the sand filters 120 and promotes the decomposition of gas hydrates such as methane hydrate in the hydrocarbon-bearing reservoirs HCL around the open hole 210. As a result, gas G, such as methane gas and natural gas, along with seawater and groundwater, flows from the hydrocarbon-bearing reservoirs HCL into the open hole 210, and then flows from the open hole 210 into the flow path within the sand control assembly 100 via the filters 122 and multiple through holes 123 in the sand filters 120. The gas G, such as methane gas and natural gas, which flows into the flow path within the sand control assembly 100 along with seawater and groundwater, is then pumped up by the pump 205 in the casing 201, and the gas and liquid are separated in the casing 201.

As shown in FIG. 1, the gas G separated in the casing 201 is sent through the gas production tube 302 to the floating production facility 300 above the sea surface OS for collection. The liquid such as seawater and groundwater separated in the casing 201 is pumped up by the pump 205 and collected through the water production tube 301 into the produced water tank 304 of the floating production facility 300 above the sea surface OS. In this way, the gas production method GPM shown in FIG. 3 is completed.

The following describes the advantageous effects of the joint assembly 110, production well manufacturing method WPM, and gas production method GPM according to the present embodiment.

The strata GS into which the production well 200 is drilled includes an isolation target layer ITL, such as a water-bearing layer SWL, between the hydrocarbon-bearing reservoirs HCL, including gas hydrate-bearing layers GHL such as methane hydrate-bearing layers MHL and natural gas hydrate-bearing layers NGL. This isolation target layer ITL, such as a water-bearing layer SWL, is presumed to be one of the causes of the production of water that hinders depressurization in the open hole 210 during gas production, and also of the production of sand.

A known technique for isolating a particular area within the open hole 210 is a packing device called a packer or tubing packer. Hydrocarbon-bearing reservoirs HCL, such as methane hydrate-bearing layers MHL, and isolation target layers ITL, such as water-bearing layers SWL, are relatively brittle and prone to collapse, and the use of a packer may expand the borehole wall 211 of the open hole 210. In the open hole 210 drilled in such collapsible strata GS, a packer cannot be used, thus failing to effectively isolate the isolation target layers ITL.

Meanwhile, the joint assembly 110 of this embodiment is configured to selectively isolate an isolation target layer ITL in an open hole 210 drilled in strata GS including hydrocarbon-bearing reservoirs HCL and isolation target layers ITL. The joint assembly 110 includes a tubular body 111 that is inserted into the open hole 210 to be positioned to penetrate the isolation target layer ITL, and a luminescence device 112 placed over the entire circumference of the outer periphery 111*o* of the body 111. The luminescence device 112 is configured to emit light to cure uncured photo-curable resin LCR that is introduced between the body 111 and the borehole wall 211 of the open hole 210.

With this configuration, the joint assembly 110 of the present embodiment is placeable at a position penetrating the isolation target layer ITL of the strata GS while having the tubular body 111 inserted into the open hole 210. The joint assembly 110 of this embodiment has the luminescence device 112 placed over the entire circumference of the outer periphery 111*o* of the body 111, the luminescence device 112 being capable of irradiating uncured photo-curable resin LCR introduced between the body 111 and the borehole wall 211 of the open hole 210 with light to cure this photo-curable resin LCR.

This allows, as shown in FIG. 10, the annular or cylindrical photo-curable resin CR cured between the body 111 of the joint assembly 110 and the borehole wall 211 of the open hole 210 to cover the borehole wall 211 at a portion of the open hole 210 that penetrates the isolation target layer ITL, thus enabling selective isolation of the isolation target layer ITL from the open hole 210. This prevents the production of water and sand from the isolation target layer ITL that would interfere with depressurization in the open hole 210, and enables efficient production of gas G from the hydrocarbon-bearing reservoir HCL. Even in an open hole 210 drilled in a collapsible strata GS, this method enables effective isolation of an isolation target layer ITL without placing a load on the borehole wall 211 of the open hole 210.

The production well manufacturing method WPM of this embodiment manufactures a production well 200 using the joint assembly 110 of this embodiment. The production well manufacturing method WPM has an open hole drilling and logging step S11 of drilling an open hole 210 in strata GS, and locating hydrocarbon-bearing reservoirs HCL and isolation target layers ITL in the strata GS. The production well manufacturing method WPM also includes step S15 of inserting a body 111 of a joint assembly 110 into the open hole 210 and positioning it at a position penetrating the isolation target layer ITL, and step S16 of introducing an uncured photo-curable resin LCR between the body 111 and the borehole wall 211 of the open hole 210. The production well manufacturing method WPM also includes step S17 of emitting light from the luminescence device 112 to cure the uncured photo-curable resin LCR between the body 111 and the borehole wall 211 of the open hole 210 over the entire circumference of the body 111, thus forming a production well 200 having the isolation target layer ITL of the open hole 210 selectively isolated by the cured photo-curable resin CR. The production well manufacturing method WPM also includes step S18 of collecting uncured photo-curable resin LCR that remains in the portion of the open hole 210 where the hydrocarbon-bearing reservoirs HCL are exposed.

With this configuration, the production well manufacturing method WPM of the present embodiment allows the drilling of an open hole 210 into strata GS that contains a hydrocarbon-bearing reservoir HCL and an isolation target layer ITL, and the locating of the hydrocarbon-bearing reservoir HCL and the isolation target layer ITL in the strata GS. Then, the method inserts the body 111 of the joint assembly 110 according to the present embodiment into the open hole 210 to be placed at a position penetrating the isolation target layer ITL in the strata GS, and emits light from the luminescence device 112 placed over the entire circumference of the outer periphery 111*o* of the body 111 to uncured photo-curable resin LCR that is introduced between the body 111 and the borehole wall 211 of the open hole 210.

This selectively cures the uncured photo-curable resin LCR, which is in contact with the isolation target layer ITL exposed to the borehole wall 211 of the open hole 210, over the entire circumference of the borehole wall 211, thus forming a production well 200 having the isolation target layer ITL selectively isolated from the open hole 210 by the cured photo-curable resin CR. After that, the method collects uncured photo-curable resin LCR that remains in the portion of the open hole 210 where the hydrocarbon-bearing reservoirs HCL are exposed, thereby manufacturing a production well 200 that is capable of yielding hydrocarbon from the hydrocarbon-bearing reservoir HCL selectively exposed to the borehole wall 211 of the open hole 210.

In this production well manufacturing method WPM of this embodiment, in step S17 to cure the uncured photo-curable resin LCR to form the production well 200 having the isolation target layers ITL selectively isolated, uncured photo-curable resin LCR still remains above the cured photocurable resin CR.

Although the cured photo-curable resin CR may contract and create a gap between the borehole wall 211 of the open hole 210 and the cured photo-curable resin CR, the uncured photo-curable resin LCR remaining above the cured photo-curable resin CR will flow into the gap and cure to fill the gap. This prevents the formation of a gap between the cured photo-curable resin CR and the isolation target layer ITL exposed to the borehole wall 211 of the open hole 210, thereby isolating the isolation target layer ITL from the open hole 210 more reliably.

In the production well manufacturing method WPM of this embodiment, each hydrocarbon-bearing reservoir HCL is a gas hydrate-bearing layer GHL, and each isolation target layer ITL is a water-bearing layer SWL.

With this configuration, the production well manufacturing method WPM of the present embodiment allows the drilling of an open hole 210 into strata GS that contains a gas hydrate-bearing layer GHL that bears hydrocarbon such as methane hydrate and a water-bearing layer SWL to form a production well 200 having the water-bearing layer SWL selectively isolated from the open hole 210. Therefore, the method manufactures a production well 200 that is capable of efficiently producing hydrocarbon gas such as methane gas from the gas hydrate-bearing layer GHL selectively exposed on the borehole wall 211 of the open hole 210.

The gas production method GPM of this embodiment includes the production well manufacturing method WPM of this embodiment. The gas production method GPM of this embodiment includes step S2, following step S18 of collecting the uncured photo-curable resin LCR. In step S2, the pressure of the production well 200 is reduced to collect the gas G released from the gas hydrate-bearing layer GHL to the production well 200.

With this configuration, the gas production method GPM of this embodiment uses the production well 200 having the water-bearing layer SWL exposed to the borehole wall 211 of the open hole 210 and selectively isolated, and being capable of efficiently producing hydrocarbon gas such as methane gas from the gas hydrate-bearing layer GHL selectively exposed to the borehole wall 211 of the open hole 210, thus efficiently producing the gas G by the depressurization method.

As described above, the present embodiment provides the joint assembly 110 that selectively isolates the isolation target layer ITL in the open hole 210 drilled in the strata GS including the hydrocarbon-bearing reservoir HCL and the isolation target layer ITL, and provides the production well manufacturing method WPM and gas production method GPM using the joint assembly 110.

Embodiment 2

Referring to FIGS. 11 through 16 together with FIGS. 1 through 10, the following describes a joint assembly that is Embodiment 2 according to the present disclosure.

Figure 11:
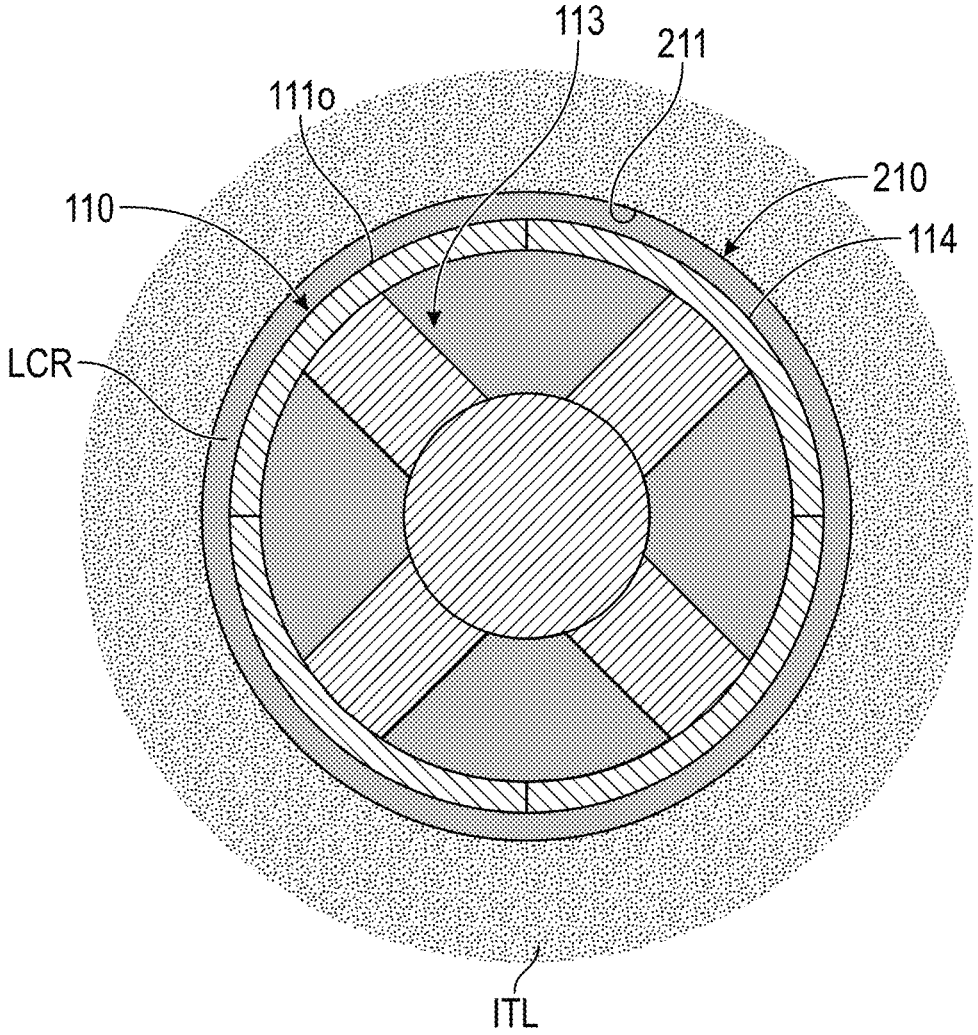
FIG. 11 is a horizontal cross-sectional view illustrating a joint assembly that is Embodiment 2 according to the present disclosure.
Figure 12:
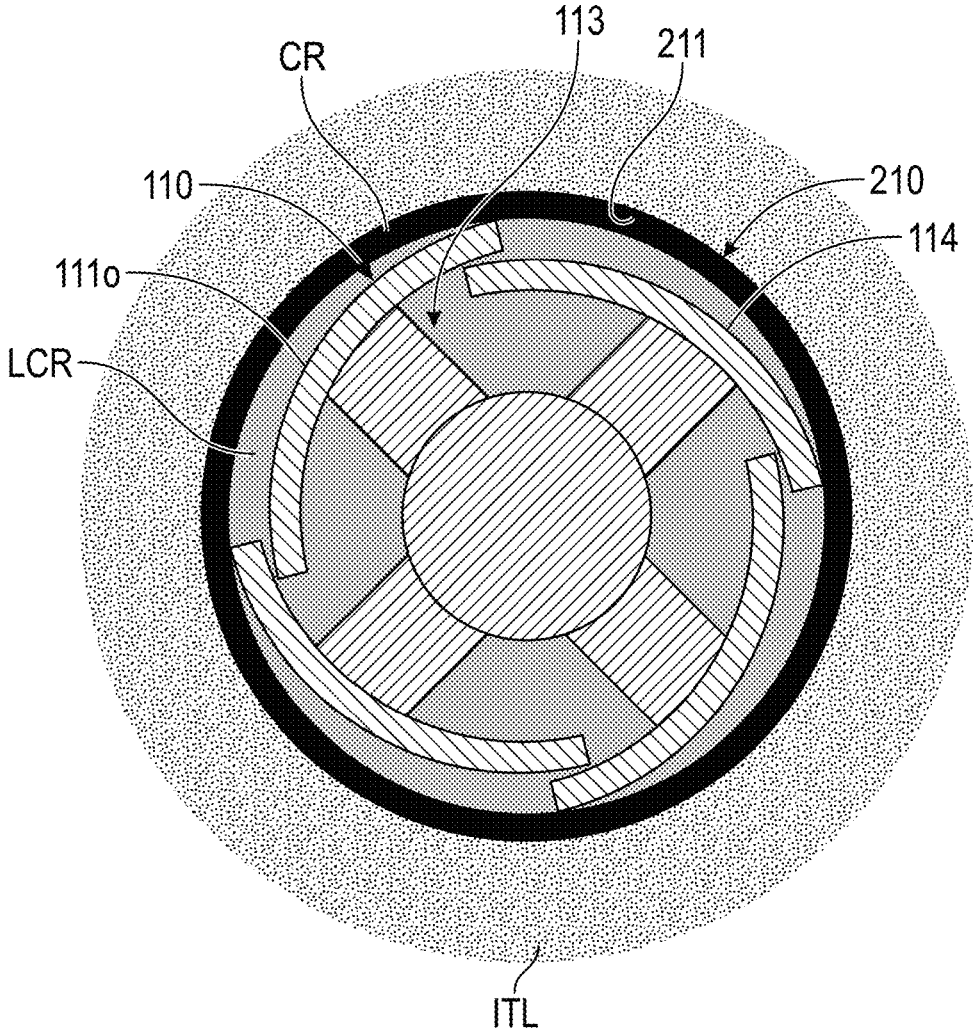
FIG. 12 is a horizontal cross-sectional view illustrating a joint assembly that is Embodiment 2 according to the present disclosure.

FIGS. 11 and 12 are horizontal cross-sectional views illustrating a joint assembly that is Embodiment 2 according to the present disclosure. The joint assembly 110 of this embodiment has a contraction mechanism 113 that contracts the outer periphery 111*o* of the body 111 from the expanded position outside in the radial direction of the body 111 shown in FIG. 11 to the contracted position inside in the radial direction of the body 111 shown in FIG. 12.

The joint assembly 110 of this embodiment emits light from the luminescence device 112 when the outer periphery 111*o* of the body 111 is in the expanded position shown in FIG. 11, thereby curing the uncured photo-curable resin LCR between the body 111 and the borehole wall 211 of the open hole 210. Thereafter, as shown in FIG. 12, the contraction mechanism 113 is operated to contract the outer periphery 111*o* of the body 111 to a contracted position inside in the radial direction. This allows the outer circumferential surface of the outer periphery 111*o* of the body 111 to be separated from the inner circumferential surface of the cured photo-curable resin CR covering the borehole wall 211 of the open hole 210 at the part penetrating the isolation target layer ITL.

Figure 13:
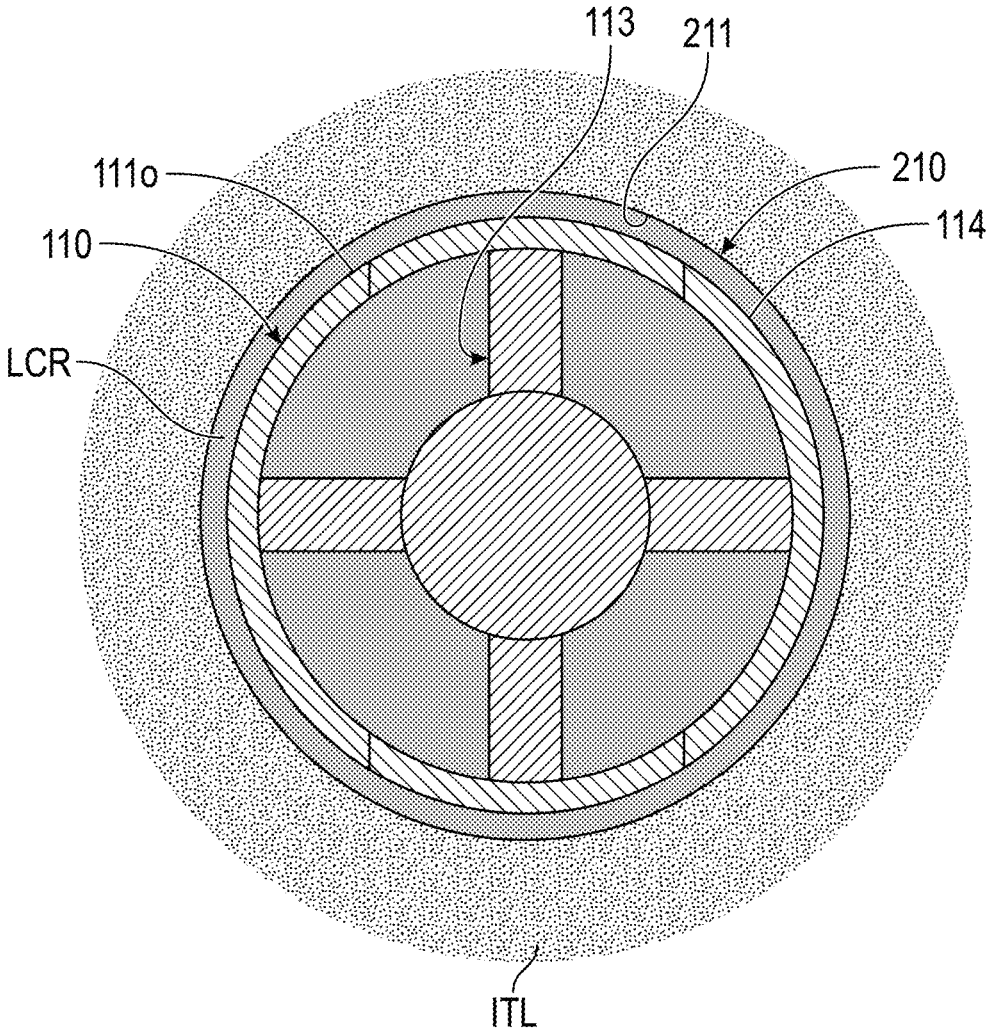
FIG. 13 is a horizontal cross-sectional view of a joint assembly that is a modified example of FIGS. 11 and 12.
Figure 14:
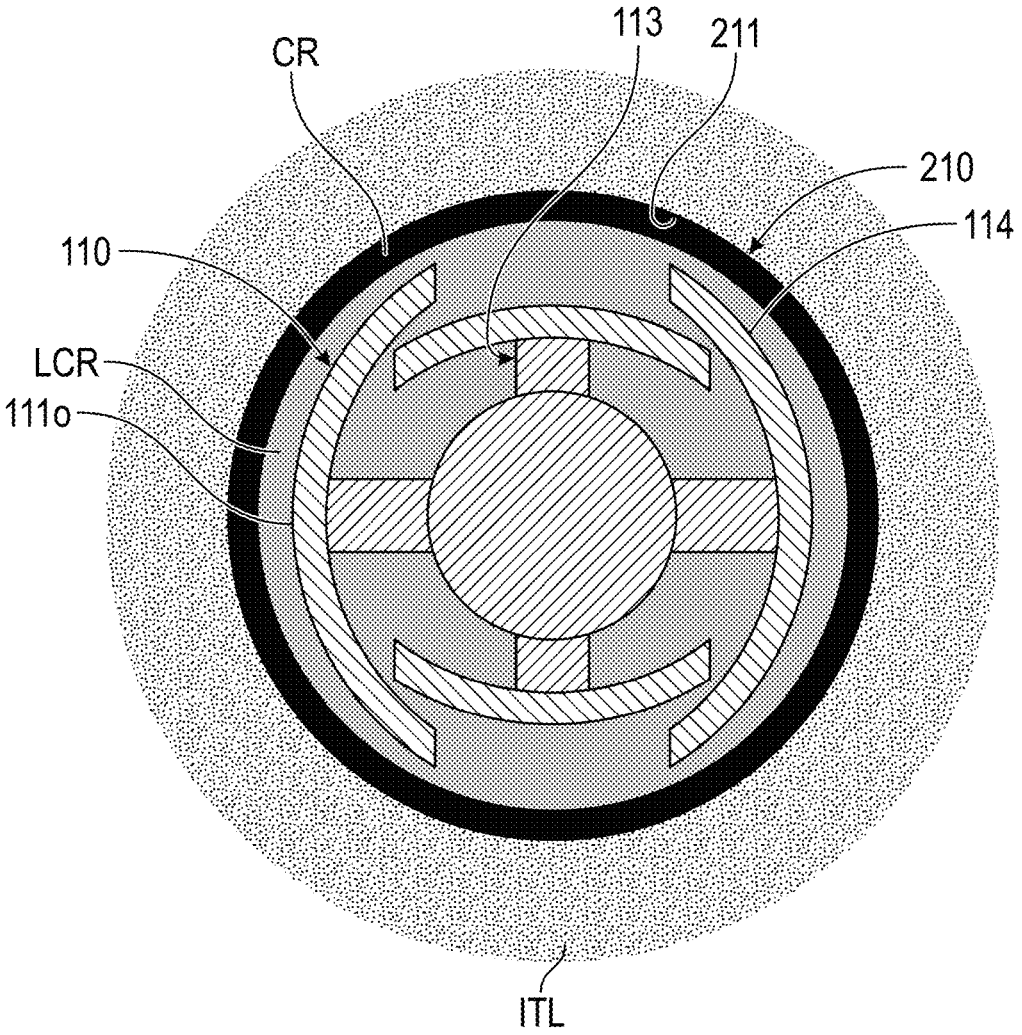
FIG. 14 is a horizontal cross-sectional view of a joint assembly that is a modified example of FIGS. 11 and 12.

The contraction mechanism 113 of the joint assembly 110 is not limited to the configuration shown in FIGS. 11 and 12. FIGS. 13 and 14 are horizontal cross-sectional views of a joint assembly that is a modified example of FIGS. 11 and 12. The joint assembly 110 may have a contraction mechanism 113 configured shown in FIGS. 13 and 14. Similar to the joint assembly 110 of FIGS. 11 and 12, the joint assembly 110 of this modified example allows the outer circumferential surface of the outer periphery 111*o* of the body 111 to be separated from the inner circumferential surface of the cured photo-curable resin CR covering the borehole wall 211 of the open hole 210 at the part penetrating the isolation target layer ITL. In the examples shown in FIGS. 11 through 14, the central shaft supporting the contraction mechanism 113 may be a hollow pipe to define a flow path therein, and the flow path may serve as a passage for the uncured photo-curable resin LCR, water, or others.

Figure 15:
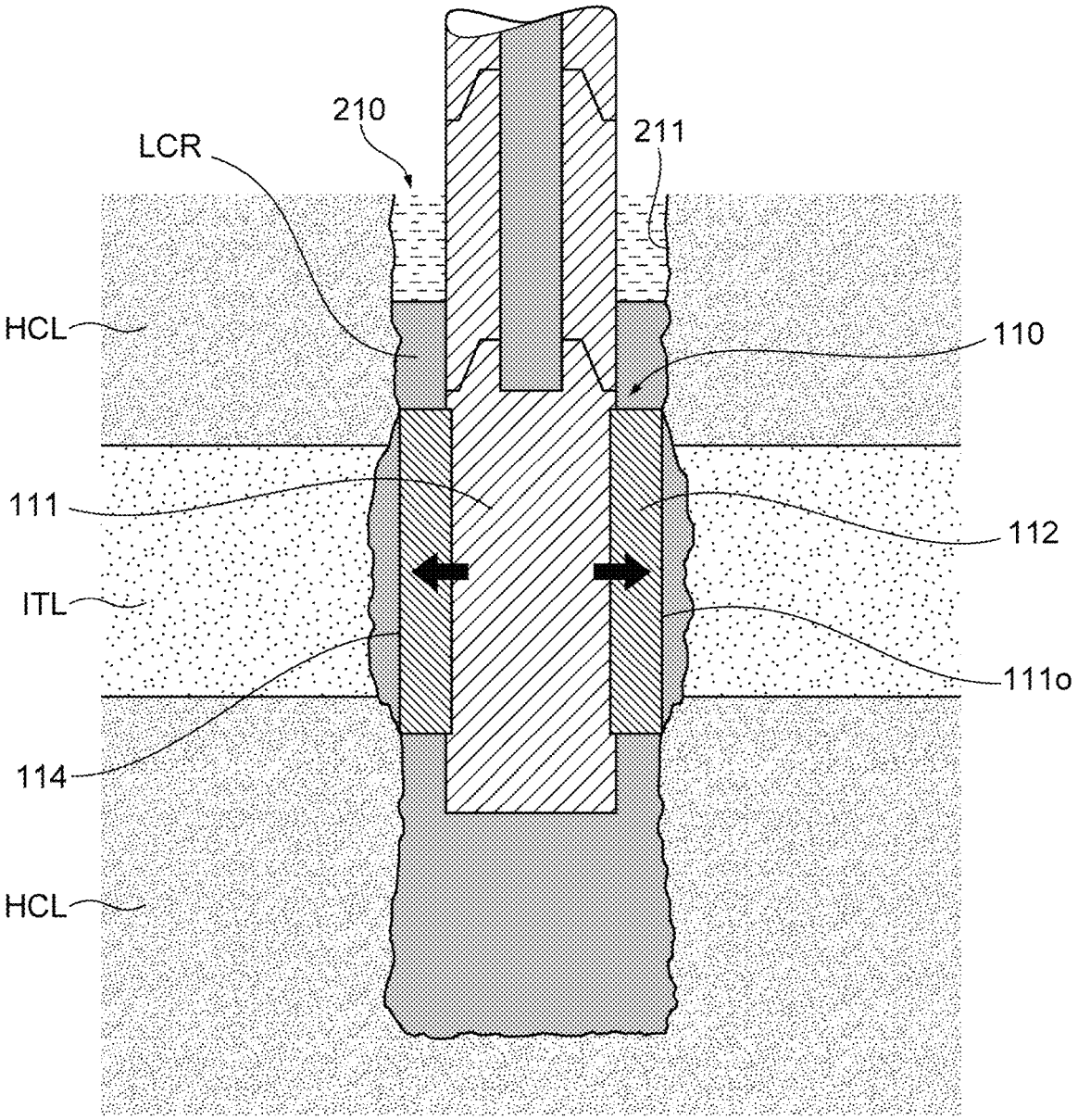
FIG. 15 is a cross-sectional view of the joint assembly with the outer periphery of the body in the expanded position as shown in FIGS. 11 and 13.
Figure 16:
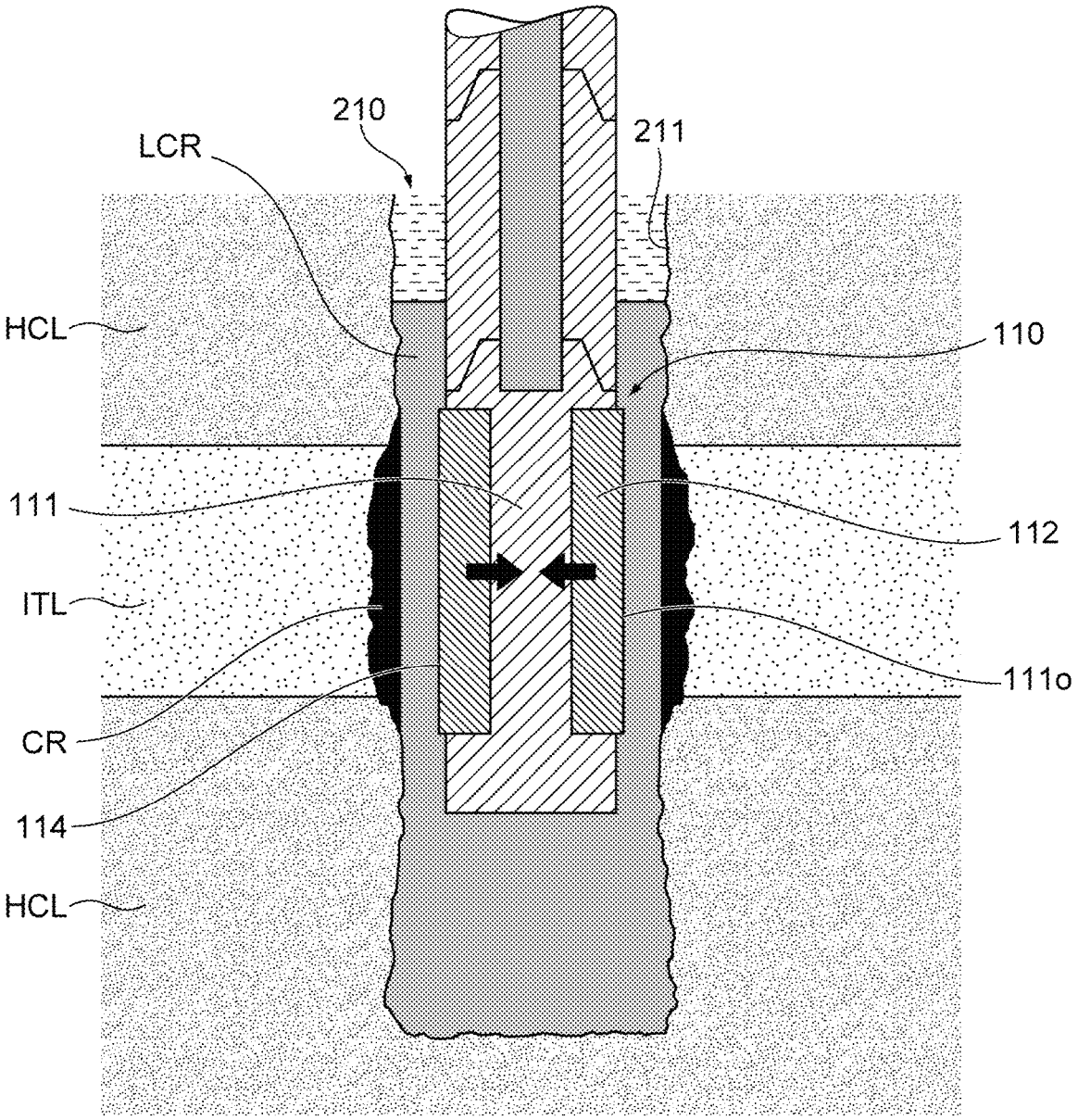
FIG. 16 is a cross-sectional view of the joint assembly with the outer periphery of the body in the contracted position as shown in FIGS. 12 and 14.

FIG. 15 is a cross-sectional view of the joint assembly 110 with the outer periphery 111*o* of the body 111 in the expanded position as shown in FIGS. 11 and 13. FIG. 16 is a cross-sectional view of the joint assembly 110 with the outer periphery 111*o* of the body 111 in the contracted position as shown in FIGS. 12 and 14.

In the strata GS, isolation target layers ITL, such as water-bearing layers SWL, more easily collapse than hydrocarbon-bearing reservoirs HCL, such as methane hydrate-bearing reservoirs MHL, and the borehole wall 211 may be scooped out to have a concave shape during the drilling of the open hole 210. In this case, as shown in FIG. 15, the outer periphery 111*o* of the body 111 in the expanded position is set along the hydrocarbon-bearing reservoirs HCL above and below the isolation target layer ITL, and light is then emitted from the luminescence device 112 to cure the hydrocarbon-bearing reservoir HCL between the borehole wall 211 and the body 111.

Thereafter, as shown in FIG. 16, the contraction mechanism 113 is operated to contract the outer periphery 111*o* of the body 111 to a contracted position inside in the radial direction of the body 111. This allows the outer circumferential surface of the outer periphery 111*o* of the body 111 to be separated from the inner circumferential surface of the cured photo-curable resin CR, and thus enables the removal of the joint assembly 110 from the open hole 210 having the isolation target layer ITL isolated by the cured photo-curable resin CR. Thereafter, the sand control assembly 100 equipped with the sand filter 120 may be inserted into the open hole 210 with the isolation target layer ITL isolated, and the uncured photo-curable resin LCR may be collected to produce gas G.

The joint assembly 110 of this embodiment may include an anti-adhesion layer 114 on the outer surface of the body 111 to prevent adhesion of the cured photo-curable resin CR and the body 111. The anti-adhesion layer 114 may include grease that transmits the light emitted from the luminescence device 112, or a polytetrafluoroethylene (PTFE) sheet.

With this configuration, the joint assembly 110 of this embodiment lets the luminescence device 112 emit light to the uncured photo-curable resin LCR through the light-transmissive anti-adhesion layer 114 placed on the outer surface of the body 111, so that the photo-curable resin CR after curing is in contact with the anti-adhesion layer 114. Thus, the anti-adhesion layer 114 prevents the cured photo-curable resin CR from adhering to the outer surface of the body 111, and when the contraction mechanism 113 is operated to contract the outer periphery 111*o* of the body 111 radially inward, the outer circumferential surface of the outer periphery 111*o* is easily separated from the inner circumferential surface of the cured photo-curable resin CR.

As described above, the present embodiment provides the joint assembly 110 that selectively isolates the isolation target layer ITL in the open hole 210 drilled in the strata GS including the hydrocarbon-bearing reservoir HCL and the isolation target layer ITL, and provides the production well manufacturing method WPM and gas production method GPM using the joint assembly 110.

That is a detailed description of the embodiments of the joint assembly, production well manufacturing method, and gas production method according to the present disclosure, with reference to the drawings. The specific configuration of the present disclosure is not limited to the above-stated embodiments, and the design may be modified variously without departing from the spirits of the present disclosure. The present disclosure also covers such modified embodiments. For instance, hydrocarbon-bearing reservoirs are not limited to gas hydrate-bearing layers, such as methane hydrate-bearing layers, as mentioned above, but may also include layers containing oil, natural gas, shale gas and oil.

The following is a description of experiments conducted to verify the effectiveness of the joint assembly according to the present disclosure.

Experiment 1

Figure 17:
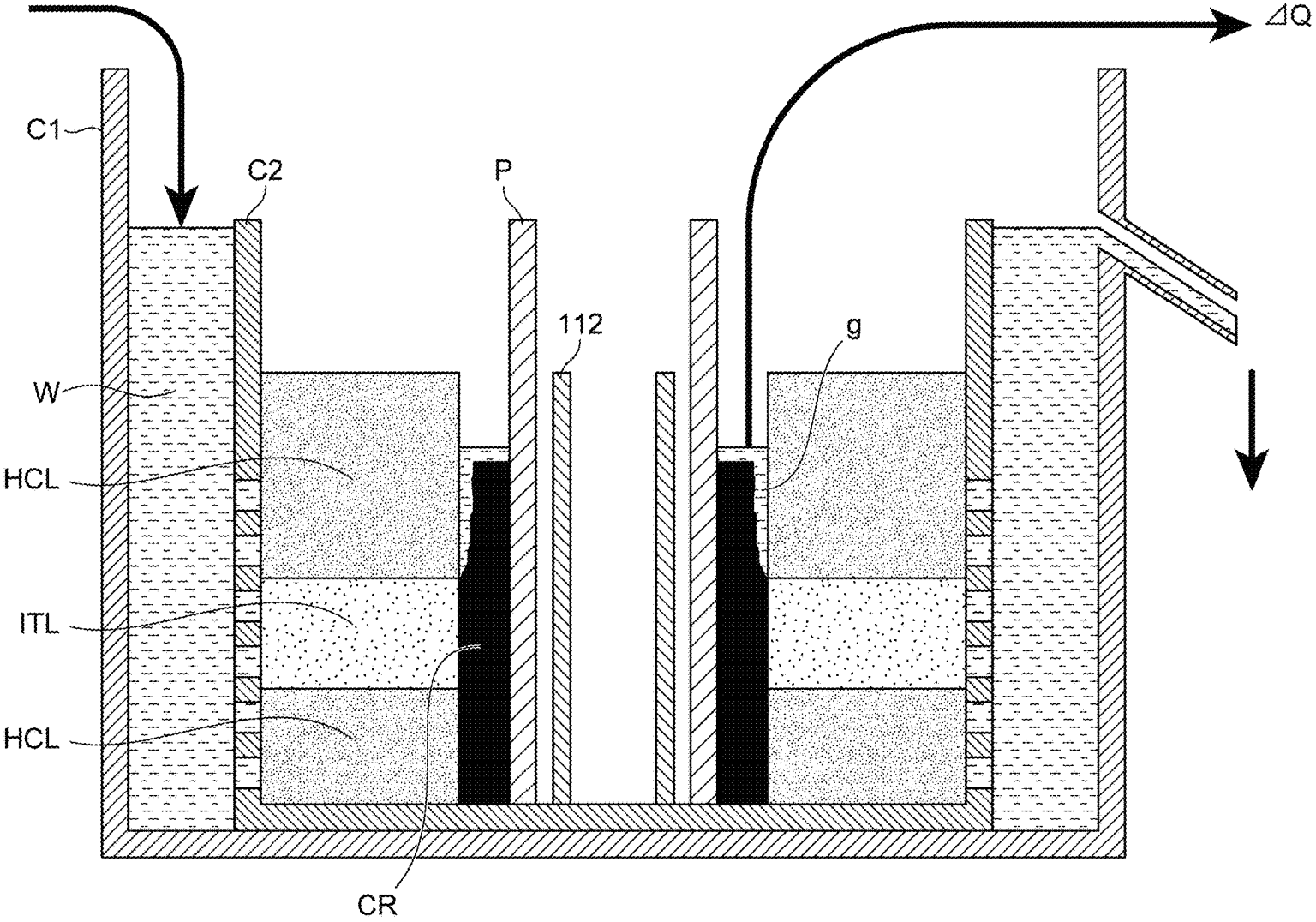
FIG. 17 is a schematic cross-sectional view of the apparatus used in Experiment 1.

FIG. 17 is a schematic cross-sectional view of the apparatus used in Experiment 1. As shown in FIG. 17, a cylindrical container C2 having a plurality of through holes in the side wall was placed inside a cylindrical container C1 which was larger than the container C2. Then, hydrocarbon-bearing reservoirs HCL simulating methane hydrate-bearing layers and an isolation target layer ITL simulating a water-bearing layer were stacked in the inner container C2, and a cylindrical hole simulating an open hole 210 was formed in the center. A transparent acrylic pipe P was placed inside the hole, and a luminescence device 112 was placed inside the pipe P around the entire circumference of the pipe P.

Water W was then supplied between the container C1 and the container C2 to let the water W permeate into the hydrocarbon-bearing reservoirs HCL and isolation target layer ITL through the through holes in the side wall of the container C2 by hydraulic head pressure. Uncured photo-curable resin LCR was further introduced between the hole simulating the open hole 210 and the pipe P, and light was irradiated from the luminescence device 112 to cure all introduced uncured photo-curable resin LCR. As a result, the photo-curable resin CR after curing contracted, thus forming a gap g between the cured photo-curable resin CR and the hole simulating the open hole 210.

Thereafter, water W that had permeated the hydrocarbon-bearing reservoirs HCL and the isolation target layer ITL and accumulated in the hole simulating the open hole 210 was pumped up, and the water production amount ΔQ was measured. The result shows that the water production amount ΔQ was reduced to about one-third compared to the configuration without isolating the isolation target layer ITL by the cured photo-curable resin CR. This demonstrates that the isolation of the isolation target layer ITL was effective.

Experiment 2

Figure 18:
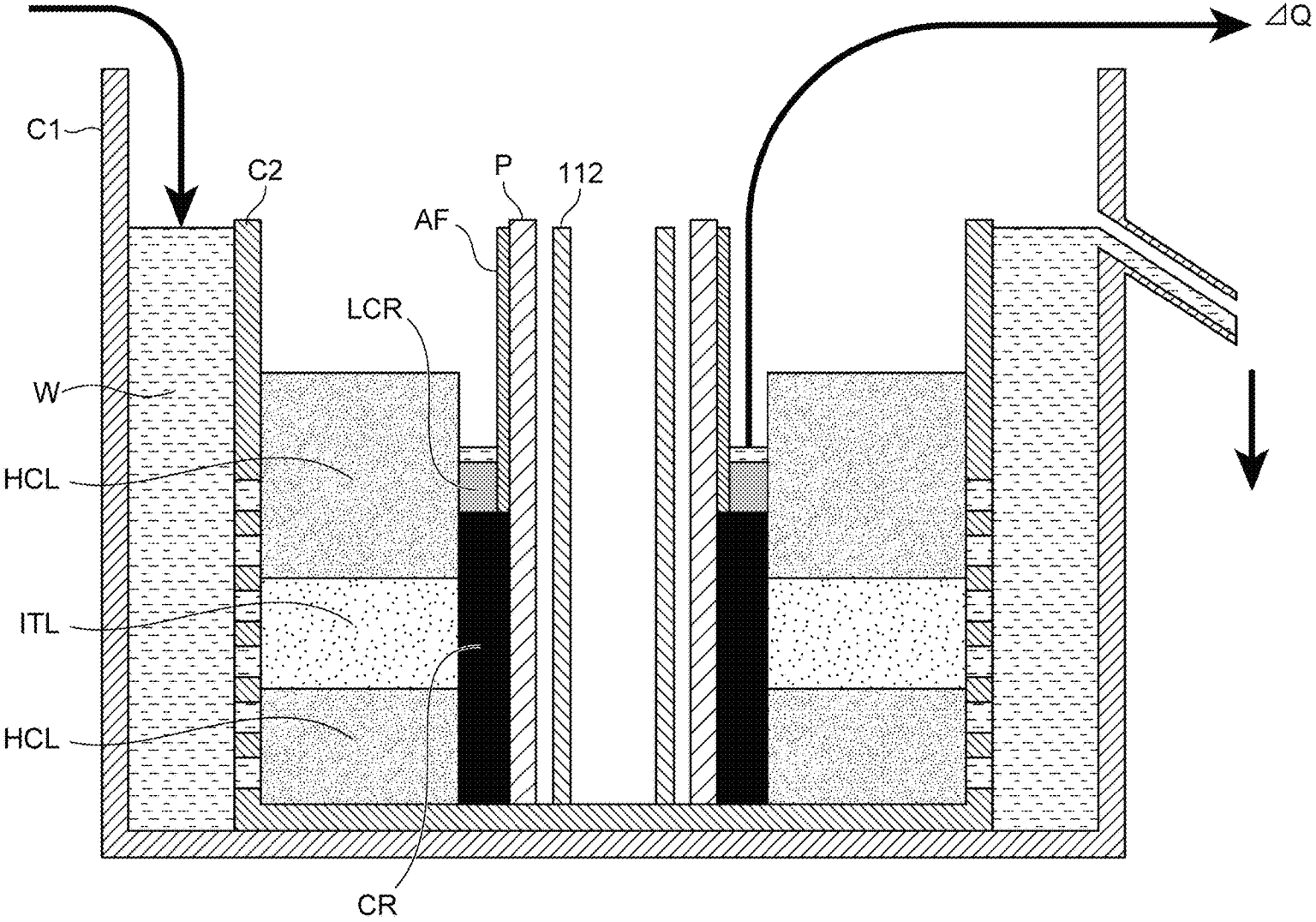
FIG. 18 is a schematic cross-sectional view of the apparatus used in Experiment 2.

FIG. 18 is a schematic cross-sectional view of the apparatus used in Experiment 2. In Experiment 2, the height of luminescence device 112 was made higher than in Experiment 1, and the outer circumferential surface of the upper portion of pipe P was covered with aluminum foil AF. After that, similar to Experiment 1, water W was supplied between the container C1 and the container C2 to let the water W permeate into the hydrocarbon-bearing reservoirs HCL and isolation target layer ITL through the through holes in the side wall of the container C2 by hydraulic head pressure. Uncured photo-curable resin LCR was then introduced between the hole simulating the open hole 210 and the pipe P, so that the photo-curable resin LCR was poured to the middle of the portion of the pipe P covered with aluminum foil AF.

Thereafter, light was emitted from the luminescence device 112 to cure the uncured photo-curable resin LCR below the portion of the pipe P covered with the aluminum foil AF. As a result, no gap g was formed between the cured photo-curable resin CR and the hole simulating the open hole 210. Presumably, this is because uncured photo-curable resin LCR remaining outside the portion of pipe P covered with the aluminum foil AF was supplied to the gap g between the cured photo-curable resin CR and the hole simulating the open hole 210, and the resin cured to fill the gap g.

Thereafter, water W that had permeated the hydrocarbon-bearing reservoirs HCL and the isolation target layer ITL and accumulated in a hole simulating the open hole 210 was pumped up, and the water production amount ΔQ was measured. The result shows that the water production amount ΔQ was substantially zero. This demonstrates that the isolation of the isolation target layer ITL was effective. In this experiment, resin A (UV resin High transparency manufactured by NOVA3D) and resin B (Alpha Resin LV8-1 manufactured by Alpha Kaken) were used as the photo-curable resin LCR, and similar results were obtained from both.

REFERENCE SIGNS LIST

110 Joint assembly
111 Body
111*o* Outer periphery
112 Luminescence device
113 Contraction mechanism
114 Anti-adhesion layer
200 Production well
210 Open hole
211 Borehole wall CR Cured photo-curable resin
G Gas
GHL Gas hydrate-bearing layer
GPM Gas production method
GS Strata
HCL Hydrocarbon-bearing reservoir
ITL Isolation target layer
LCR Uncured photo-curable resin
SWL Water-bearing layer
WPM Production well manufacturing method

The invention claimed is:

1. A joint assembly, used in an open hole drilled in strata including a hydrocarbon-bearing reservoir and an isolation target layer, and configured to selectively isolate the isolation target layer, the joint assembly comprising:

a tubular body to be inserted into the open hole to be positioned to penetrate the isolation target layer;

a light source disposed over an entire circumference of an outer periphery of the tubular body and configured to emit light to cure uncured photo-curable resin that is introduced between the tubular body and a borehole wall of the open hole; and an actuator configured to contract the outer periphery from a radially expanded position to a radially contracted position.

2. A production well manufacturing method using the joint assembly according to claim 1, comprising:

drilling the open hole into the strata;

locating the hydrocarbon-bearing reservoir and the isolation target layer in the strata;

inserting the tubular body into the open hole to place the tubular body at a position penetrating the isolation target layer;

introducing the uncured photo-curable resin between the tubular body and the borehole wall of the open hole;

emitting the light from the light source to cure the uncured photo-curable resin between the tubular body and the borehole wall of the open hole over the entire circumference of the tubular body, thus forming a production well with the isolation target layer being selectively isolated by the cured photo-curable resin; and collecting the uncured photo-curable resin that remains in a portion of the open hole where the hydrocarbon-bearing reservoir is exposed.

3. The production well manufacturing method according to claim 2, wherein the production well is formed while leaving the uncured photo-curable resin above the cured photo-curable resin.

4. A joint assembly, used in an open hole drilled in strata including a hydrocarbon-bearing reservoir and an isolation target layer, and configured to selectively isolate the isolation target layer, the joint assembly comprising:

a tubular body to be inserted into the open hole to be positioned to penetrate the isolation target layer;

a light source disposed over an entire circumference of an outer periphery of the tubular body and configured to emit light to cure uncured photo-curable resin that is introduced between the tubular body and a borehole wall of the open hole; and an anti-adhesion layer on an outer surface of the tubular body, the anti-adhesion layer preventing adhesion of the cured photo-curable resin and the tubular body.

5. The joint assembly according to claim 4, further comprising an actuator configured to contract the outer periphery from a radially expanded position to a radially contracted position.

6. A production well manufacturing method using the joint assembly according to claim 4, comprising:

drilling the open hole into the strata;

locating the hydrocarbon-bearing reservoir and the isolation target layer in the strata;

inserting the tubular body into the open hole to place the tubular body at a position penetrating the isolation target layer;

introducing the uncured photo-curable resin between the tubular body and the borehole wall of the open hole;

emitting the light from the light source to cure the uncured photo-curable resin between the tubular body and the borehole wall of the open hole over the entire circumference of the tubular body, thus forming a production well with the isolation target layer being selectively isolated by the cured photo-curable resin; and collecting the uncured photo-curable resin that remains in a portion of the open hole where the hydrocarbon-bearing reservoir is exposed.

7. The production well manufacturing method according to claim 6, wherein the production well is formed while leaving the uncured photo-curable resin above the cured photo-curable resin.

8. The production well manufacturing method according to claim 6, wherein the hydrocarbon-bearing reservoir includes a gas hydrate-bearing layer, and the isolation target layer includes a water-bearing layer.

9. A gas production method, comprising:

the production well manufacturing method according to claim 8; and following the collecting of the uncured photo-curable resin, reducing a pressure of the production well to collect gas released from the hydrocarbon-bearing reservoir to the production well.

10. A production well manufacturing method using the joint assembly according to claim 5, comprising:

drilling the open hole into the strata;

locating the hydrocarbon-bearing reservoir and the isolation target layer in the strata;

inserting the tubular body into the open hole to place the tubular body at a position penetrating the isolation target layer;

introducing the uncured photo-curable resin between the tubular body and the borehole wall of the open hole;

emitting the light from the light source to cure the uncured photo-curable resin between the tubular body and the borehole wall of the open hole over the entire circumference of the tubular body, thus forming a production well with the isolation target layer being selectively isolated by the cured photo-curable resin; and collecting the uncured photo-curable resin that remains in a portion of the open hole where the hydrocarbon-bearing reservoir is exposed.

11. A production well manufacturing method, comprising:

drilling an open hole into strata;

locating a hydrocarbon-bearing reservoir and an isolation target layer in the strata;

inserting a tubular body into the open hole to place the tubular body at a position penetrating the isolation target layer;

introducing an uncured photo-curable resin between the tubular body and a borehole wall of the open hole;

emitting light from a light source to cure the uncured photo-curable resin between the tubular body and the borehole wall of the open hole over an entire circumference of the tubular body, thus forming a production well with the isolation target layer being selectively isolated by the cured photo-curable resin, the production well being formed while leaving the uncured photo-curable resin above the cured photo-curable resin; and collecting the uncured photo-curable resin that remains in a portion of the open hole where the hydrocarbon-bearing reservoir is exposed.

12. The production well manufacturing method according to claim 11, wherein the hydrocarbon-bearing reservoir includes a gas hydrate-bearing layer, and the isolation target layer includes a water-bearing layer.

13. The production well manufacturing method according to claim 11, further comprising contracting an outer periphery of the tubular body from a radially expanded position to a radially contracted position.

14. The production well manufacturing method according to claim 11, further comprising preventing adhesion of the cured photo-curable resin and the tubular body.

15. A gas production method, comprising:

the production well manufacturing method according to claim 12; and following the collecting of the uncured photo-curable resin, reducing a pressure of the production well to collect gas released from the hydrocarbon-bearing reservoir to the production well.

* * * * *